US005793400A

United States Patent [19]

Mukoyama et al.

[11] Patent Number: 5,793,400

[45] Date of Patent: Aug. 11, 1998

[54] IMAGE RECORDING APPARATUS BY A WET TYPE ELECTRO-PHOTOGRAPHIC METHOD AND EXCESS LIQUID DEVELOPER REMOVING DEVICE USED IN THE APPARATUS

[75] Inventors: Tatsuya Mukoyama, Yokosuka; Tsuyoshi Ono, Machida; Masahiko Okabe, Yamato; Ryuji Horiuchi, Yokohama; Hiroki Nakagami, Yokosuka, all of Japan

[73] Assignee: Victor Company of Japan, Ltd., Japan

[21] Appl. No.: 556,376

[22] Filed: Nov. 13, 1995

[30] Foreign Application Priority Data

| | | | |
|---|---|---|---|
| Nov. 11, 1994 | [JP] | Japan | 6-302776 |
| Nov. 17, 1994 | [JP] | Japan | 6-308132 |
| Dec. 6, 1994 | [JP] | Japan | 6-330105 |
| May 29, 1995 | [JP] | Japan | 7-155212 |

[51] Int. Cl.[6] ..... B41J 2/385; G03G 13/04

[52] U.S. Cl. ..... 347/140; 399/249

[58] Field of Search ..... 347/156, 153, 347/155, 140; 399/241, 249

[56] References Cited

FOREIGN PATENT DOCUMENTS 6-11942 1/1994 Japan .
6-19327 1/1994 Japan .
6-51642 2/1994 Japan .

*Primary Examiner*—N. Le
*Assistant Examiner*—L. Anderson
*Attorney, Agent, or Firm*—Michael N. Meller

[57] ABSTRACT

The present invention provides an image recording apparatus and an excess liquid developer removing device used in the apparatus. In the image recording apparatus, the recording medium wound around the rotary drum is developed by liquid developer supplied from a developing device. A dish provided on the developing device is displaced in the vicinity of the recording medium wound around the rotary drum by being declined in a predetermined angle to prevent the bubbles from generating. The excess liquid developer attached on the recording medium is removed by the air from a nozzle of a blower. The nozzle is displaced by a nozzle displacing device in the vicinity of a developing electrode for supplying the liquid developer only in the midst of developing to prevent the nozzle from being chocked up with toner contained in the liquid developer. Further, the excess liquid developer collected to an end of the recording medium by the air are removed by a part of the excess liquid developer absorbing member caused by the contact therewith.

14 Claims, 14 Drawing Sheets

IMAGE RECORDING APPARATUS BY A WET TYPE ELECTRO-PHOTOGRAPHIC METHOD AND EXCESS LIQUID DEVELOPER REMOVING DEVICE USED IN THE APPARATUS

BACKGROUND OF THE INVENTION

1. Field of the Invention

This invention relates to improvements of image recording apparatuses and methods of wet type electro-photographic process adaptable to the apparatuses, and particularly relates to techniques for preventing bubbles from generating in liquid developer and excess liquid developer removing techniques or devices for removing excess liquid developer remaining on a surface of a photosensitive medium carrying an electrostatic latent image upon developing.

2. Description of the Related Arts

Generally, in electro-photographic techniques, an electrostatic latent image is recorded on a rotary drum or a surface of a photosensitive material by utilizing static electricity, and an electrostatic latent image is visualized by causing the electrostatic latent image to attract toner of a developer in a developing process.

Next, a description is given of an example of an image forming apparatus in the prior art by a typical electro-photographic method in reference with FIGS. 1 and 2.

FIG. 1 is a schematic side view of a typical electro-photographic apparatus in the prior art; and FIG. 2 is an enlarged sectional side view of a developing tub shown in FIG. 1 in the prior art.

The image forming apparatus shown in the drawings is used, for instance, for producing a planographic sheet and a proof for a high quality print.

Referring to FIGS. 1 and 2, wherein a numerical character 101 designates a rotary drum. A photosensitive member 103 derived from a roll 102 is wound around a rotary drum 101 by rotating the rotary drum 101. In the vicinity of the rotary drum 101, a corona electrification device 104, a pre-wet device 105, a single developing tub 106 or a plurality of developing tubs 106 for color printing, a squeegee 107 for blowing away liquid developer, a fan 108 for drying the liquid developer, and a discharger 109 for discharging electric charges remaining on the photosensitive member 103 are disposed in this order.

A surface of the photosensitive member 103 wound around the rotary drum 101 is uniformly electrified by the corona electrification device 104, and the electrified surface thereof is scanned by a laser beam LB modulated by image information, resulting in being exposed.

The laser beam LB is outputted in a modulated state from a laser diode 110, and irradiates the surface of the photosensitive member 103 through a polygon mirror 111 and an optical system 112.

The photosensitive member 103 is generally composed of a conductive layer made of aluminum and a photoconductive layer formed thereon. When the surface of the photosensitive member 103 is scanned by the laser beam LB, the photoconductive layer becomes conductive. Thus, the electric charges thereon are discharged through the conductive layer connected to the ground. Therefore, the electrostatic latent image composed of electrified parts and non-electrified parts is formed on the photosensitive member 103 as being scanned with the laser beam "LB" modulated by image information, i.e., on-off control of the laser beam "LB".

When the photosensitive member 103 passes through the wet tub 106 filled with the liquid developer "L", the surface of the photosensitive member 103 carrying the electrostatic latent image is wetted by pre-wet liquid in the pre-wet device 105, and is developed by liquid developer "L" containing toner. The liquid developer "L" remaining on the surface thereof is blown away and approximately removed by air blow from the squeegee 107, and the reminder on the surface thereof is dried and fixed by air from the fan 108.

In a monochromatic process, the photosensitive member 103 is finally discharged from the apparatus after dried, however, in a multichromatic process such as a color proof, after the electric charges remaining on the surface are removed by the discharger 109, a plurality of processes mentioned above are successively performed in accordance with respective colors (Y: yellow, M: magenta, C: cyan and K: black) and the photosensitive members 103 are discharged from the apparatus.

In FIG. 1, a numerical character 113 designates a toner pump, 114 a controller, and 115 an electric circuit device.

As shown in FIG. 1, the developing tub 106 is provided with a developing dish 116 capable of facing the surface of the rotary drum 101 for supplying the liquid developer "L" to the surface of the photosensitive member 103.

Specifically, the developing dish 116 has a surface **116*a* confronting the surface of the rotary drum 101. The surface 116*a* thereof has approximately the same radius as that of the rotary drum 101. In other words, a predetermined gap "G", for instance, with its length of 0.35 to 0.4 mm, is formed between the surface 116*a* of the developing dish 116 and the surface of the rotary drum 101 around which the photosensitive member 103** is provided.

The liquid developer "L" contains toner comprising electrostatic charges having an inverse polarity with respect to ones on the electrified portion of the photosensitive member 103, coloring matter (dye/pigment) and resin. Upon developing, the liquid developer "L" is supplied to the gap "G" through a supplying slit **116*b* formed on the surface 116*a* of the developing dish 116. Therefore, while the surface of the photosensitive member 103 is passing through the gap "G" filled with the liquid developer "L", the toner is attracted on the electrified portions of the photosensitive member 103**, thus the electrostatic latent image is visualized by being developed.

The above mentioned image recording apparatus has a problem in the supplying process of the liquid developer Next, a description is given of the problem in reference with FIG. 3.

FIG. 3 is a schematic sectional side view for explaining generation of bubbles in the liquid developer in the prior art.

The liquid developer "L" supplied from the toner pump 113 (FIG. 1) flows out from the supplying slit **116*b* and advances along the surface 116*a* of the developing dish 116**.

In this state, the developing tub 106 is displaced in an up direction in FIG. 1 from a waiting position where the developing tub 106 is away from the rotary drum 101.

Thus, the surface **116*a* of the developing device 116 is positioned at a developing position where the surface 116*a* is confronting with the surface of the rotary drum 101**. In this process, there is a case where bubbles "f" are generated in the liquid developer "L" because the air is confined therein.

Under the circumstance, most of the bubbles "f" are flown away along with the liquid developer "L", resulting in circularly returning to the developing tub 106, however, some of them are trapped in the supplying slit **116*b*** occasionally.

When the trapped bubbles "f" remain in the supplying slit 116*b* without vanishing during the developing process, the trapped bubbles "f" prevent the supplying slit 116*b* from supplying the liquid developer "L" normally. This causes stripes having light and shade on an image reproduced, resulting in degrading the quality of the image.

Next, a description is given of another problem in the wet type electro-photographic apparatus.

In the wet type electro-photographic apparatus, wherein an electrostatic latent image is recorded on the photosensitive medium (an image carrier) wound around the rotary drum, and the electrostatic latent image is visualized by being developed with a wet type developing device disposed nearby the rotary drum, a developing agent (referred to as liquid developer hereinafter) containing toner particles inevitably remains on the surface of the the photosensitive medium as excess liquid developer after the photosensitive medium has passed through the wet type developing device. When the excess liquid developer remains on the surface of the photosensitive medium as it is, there is a problem that the quality of the image picture is degraded conspicuously.

In order to solve the problem, there is proposed such a wet type electro-photographic apparatus having an excess liquid developer removing means disposed in the vicinity of a downstream position of the photosensitive medium for removing the residual developing agent from the surface thereof as disclosed in Japanese Patent Laid-open Publication 6-51642/94, wherein an excess liquid developer removing device is disclosed.

Next, a brief description is given of the excess liquid developer removing device disclosed in Japanese Patent Laid Open Publication 6-51642/04 for removing the excess liquid developer remaining on the photosensitive medium.

FIG. 16 is a side sectional view schematically showing an excess liquid developer removing device of the prior art.

Referring to FIG. 16, in an excess liquid developer removing device 200, a photosensitive medium 201 carrying a recorded latent image wound around a rotary drum 202 is integrally transferred in a direction of an arrow A. Further, under the rotary drum 202, a developing device 203 for developing the photosensitive medium 201 is movably provided upward and downward in a vertical direction (in directions of arrows B1, B2).

Here, in a state where the above developing device 203 is positioned in close proximity to the rotary drum 202, the electrostatic latent image recorded on the photosensitive medium 201 is visualized by causing the photosensitive medium 201 to contact with the liquid developer from an elongated developing electrode 203*a* which is provided in the developing device 203 in parallel to a shaft 202*a* of the rotary drum 202, and liquid developer overflowing are recovered in a liquid developer recovery pan 203*b*.

Further, as a liquid developer removing means, a blower 204 equipped with a nozzle 204*a* for blowing air is provided in the vicinity of a downstream position of the photosensitive medium 201 with respect to the developing device 203 to remove the excess liquid developer remaining on the photosensitive medium by causing an distal end of the nozzle 204*a* to position in the vicinity of the developing electrode 203*a* of the developing device 203.

In the developing process, though the excess liquid developer remaining on the photosensitive medium 201 is recovered in the liquid developer recovery pan 203*b* by being blown away by the air from the nozzle 204*a* of the blower 204, however, a part of the excess liquid developer blown away is collected nearby a terminal portion 201*b* of the photosensitive medium 201 in a transferring direction of the photosensitive medium 201 as shown in FIG. 21.

Generally, the terminal portion 201*b* of the photosensitive medium 201 is made of a mask area having no image adjacent to an image area 201*a*. However, there may be a case where the excess liquid developer thereon is not completely removed by the air blowing from the nozzle 204*a* of the blower 204. When the excess liquid developer is adhered to the image area 201*a* on the way in transferring the photosensitive medium 201, the degradation of the image quality have to be expected. Thus, it is necessary to remove the excess liquid developer therefrom completely, particularly, in color developing process employing a plurality of developing processes repeatedly.

SUMMARY OF THE INVENTION

Accordingly, a general object of the present invention is to provide an image recording apparatus and an excess liquid developer removing device used in the image recording apparatus in which the above disadvantages have been eliminated.

A more specific object of the present invention is to provide an image recording apparatus for recording an image on a recording medium by electrifying a surface of the recording medium uniformly and forming an electric charge image on the recording medium electrified thereon and developing the electric charge image by using liquid developer, the image recording apparatus comprising: a rotary drum having a rotatable shaft, the recording medium being wound around the rotary drum; and a developing device provided under the rotary drum for developing the electric latent image recorded on the recording medium, the developing device comprising a concave surface having approximately the same curvature as that of the rotary drum so as to face the recording medium wound around the rotary drum at a developing position for forming approximately a uniform spacing between the recording medium wound around the rotary drum and the concave surface by being transferred upon developing, and an exit section provided in the vicinity of an upstream position of the recording medium with respect to the concave surface to let the liquid developer flow out, liquid developer supplying means for filling the uniform space with the liquid developer to develop the electric latent image recorded on the recording medium, wherein the concave surface of the developing device is transferred to the developing position by causing the concave surface to be declined at a predetermined declined angle against the developing position and finally to modify the declined angle so as to form the uniform spacing between the recording medium wound around the rotary drum and the concave surface.

Another and more specific object of the present invention is to provide an image recording apparatus for recording an image on a recording medium by electrifying a surface of the recording medium uniformly and forming an electric latent image on the recording medium electrified and developing the electric latent image by using liquid developer, the image recording apparatus comprising: a rotary drum having a rotatable shaft, the recording medium being wound around the rotary drum; and a developing dish having a concave surface having approximately the same curvature as that of the rotary drum so as to face the recording medium wound around the rotary drum at a developing position for forming approximately a uniform spacing between the recording medium wound around the rotary drum and the concave surface by being transferred upon developing, and an exit section provided in the vicinity of a downstream position of the recording medium with respect to the concave surface to let the liquid developer flow out, liquid developer supplying means for filling the uniform space with the liquid developer to develop the electric charged image recorded on the recording medium, wherein a length of the concave surface of the developing dish along the surface of the rotary drum in a rotational direction thereof in section is established so that the shape of the liquid developer flowing over the developing dish in a noncontact state with the recording medium has a convex surface including a flat surface.

Another specific object of the present invention is to provide an excess liquid developer removing device used in an image recording apparatus to record an image on a photo sensitive medium by forming an electric latent image on the photosensitive medium and developing the electric latent image by using liquid developer, the excess liquid developer removing device comprising: a rotary drum around which the photosensitive medium is wound, being rotatably provided for integrally transferring the photosensitive medium therewith; a developing device having an electrode therein from which the liquid developer is supplied so as to develop the electric latent image recorded on the photosensitive medium, the developing device being displaced at a developing position by developing device transferring means in the vicinity of the photosensitive medium wound around the rotary drum in a developing process; and a blower having a nozzle from which the air is blown to remove excess liquid developer attached on the photosensitive medium in the developing process, the nozzle being provided in the vicinity of a downstream position of the photosensitive medium with respect to the developing device; and nozzle displacing means for displacing the nozzle in the vicinity of the electrode of the developing device in the midst of the developing process.

Another specific object of the present invention is to provide an excess liquid developer removing device used in an image recording apparatus to record an image on a photo sensitive medium by forming an electric latent image on the photosensitive medium and developing the electric latent image by using liquid developer, the excess liquid developer removing device comprising: a rotary drum around which the photosensitive medium is wound, being rotatably provided for integrally transferring the photosensitive medium therewith; a developing device having an electrode therein from which the liquid developer is supplied so as to develop the electric latent image recorded on the photosensitive medium, the developing device being displaced at a developing position by developing device transferring means in the vicinity of the photosensitive medium wound around the rotary drum in a developing process; and a blower having a nozzle from which the air is blown to remove excess liquid developer attached on the photosensitive medium in the developing process, the nozzle being provided in the vicinity of a downstream position of the photosensitive medium with respect to the developing device; and an excess liquid developer remover comprising a roll of an excess liquid developer absorbing member, one end of the roll being allowed to be taken up, wherein the excess liquid developer collected to an end of the photosensitive medium by the air from the nozzle of the blower is removed by a part of the excess liquid developer absorbing member caused by the contact therewith.

Other objects and further features of the present invention will be apparent from the following detailed description.

DETAILED DESCRIPTION OF THE PREFERRED EMBODIMENTS

[A first embodiment]

A description is given of a first embodiment of an image recording apparatus of the present invention in reference with FIGS. 4 through 8.

Figure 1:
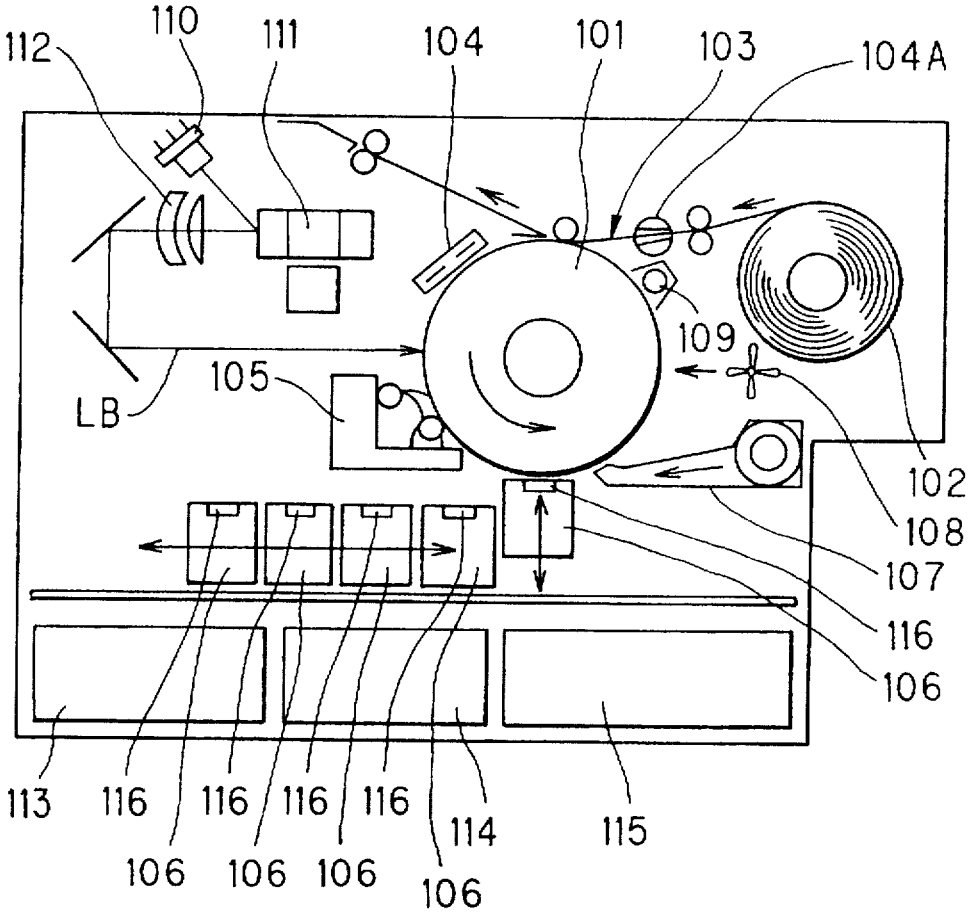
Fig.1 Prior Art
FIG. 1 is a schematic side view of a general electrophotographic apparatus in the prior art.
Figure 2:
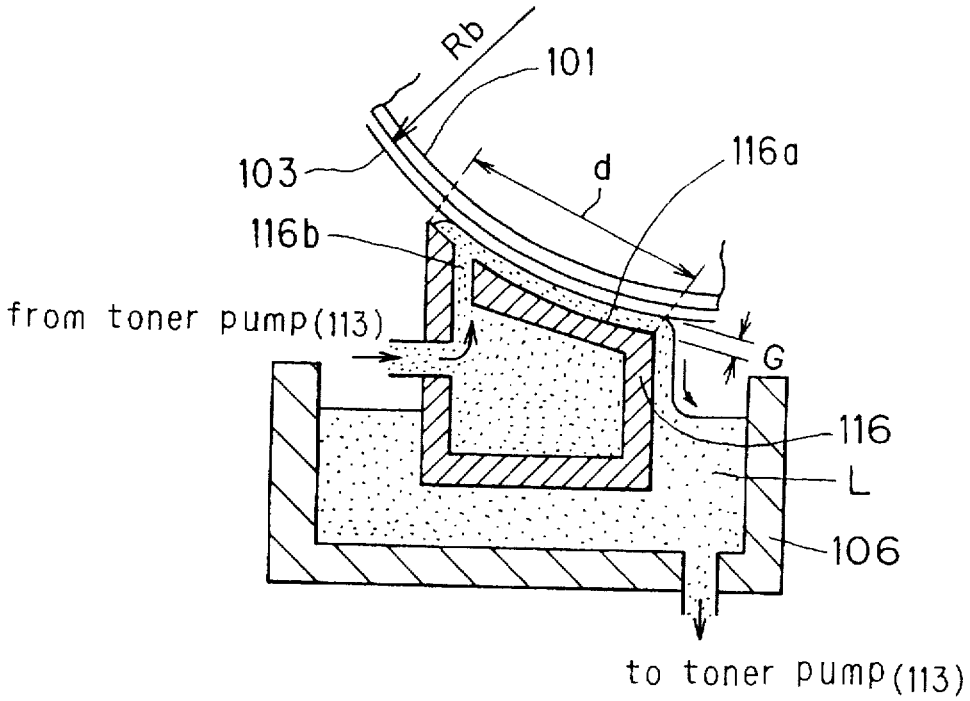
Fig.2 Prior Art
FIG. 2 is an enlarged sectional side view of a developing tub shown in FIG. 1 in the prior art.
Figure 3:
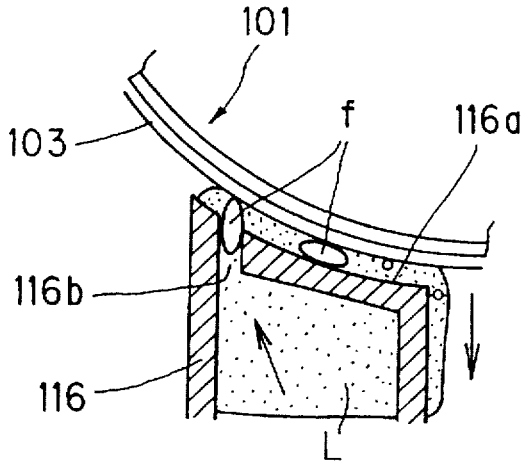
Fig.3 Prior Art
FIG. 3 is a schematic sectional side view for explaining generation of bubbles in the developing liquid in the prior art.
Figure 4:
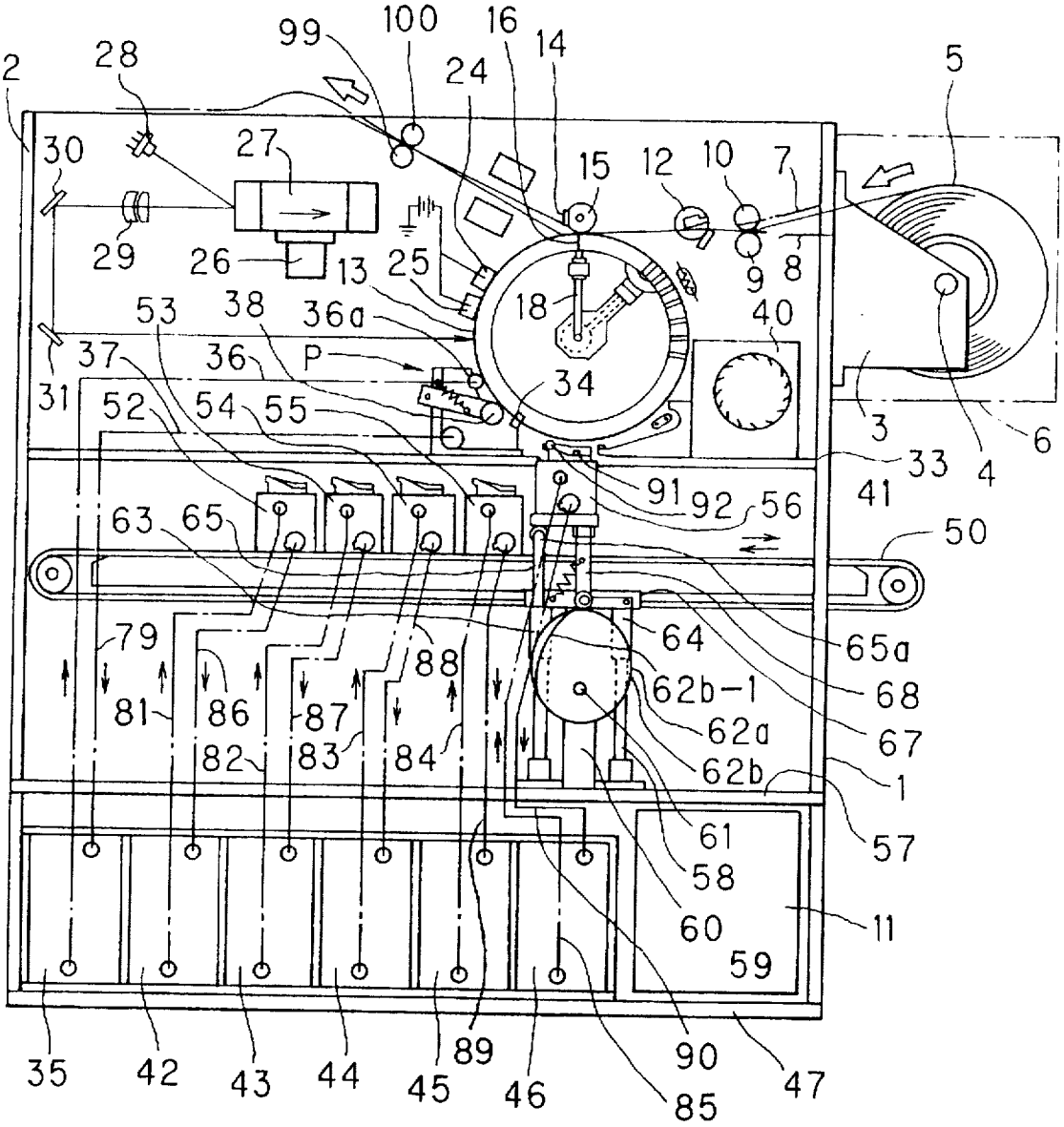
FIG. 4 is a sectional side view showing a schematic construction of a first embodiment of an image recording apparatus in the present invention.

FIG. 4 is a sectional side view showing a schematic construction of a first embodiment of an image recording apparatus in the present invention.

Referring to FIG. 4, numerical characters 1 and 2 respectively designate side plates provided in an image recording apparatus. A rotatable shaft 4 around which an electrophotographic recording paper (referred to as recording medium hereinafter) 5 is rolled, is rotatably supported by a pair of bearing plates 3 fixed on the side plate 1 in an upper level. The recording medium 5 is composed of a conductive base and a photosensitive layer formed on the conductive base, which the photosensitive layer is made of insulative resin binder including photosensitive titanium dioxide, or may be composed of an organic photosensitive material (OPC). The recording medium 5 is optically shielded by a shield member 6 shown with imaginary lines.

A control device 11 is provided for controlling various conditions such as a position of an up-down displacing device which is a main part of the present invention, a length of the recording medium, an electrification potential, a bias voltage and quantity of the developer, as mentioned hereinafter.

At the beginning of the image recording in the image recording apparatus, starting information is inputted onto an input section (not shown) by an operator. Then, the recording medium 5 is fed to a rotary drum 13 through guiding plates 7, 8 by a pair of guiding rollers 9, 10 being pinched therebetween under control of the control device 11.

Successively, a terminal position regulating member 14 provided in an upper level of the rotary drum 13 descends onto the surface of the rotary drum 13 caused by an operating cam (not shown) under the control of the control device 11. When a leading end of the recording medium 5 being fed by the guiding rollers 9, 10 abuts on the terminal position regulating member 14, a detected signal generated by a sensor (not shown) is inputted into the control device 11, and a press roller 15 presses the leading end portion of the recording medium 5 on the rotary drum 13 by being displaced downward by a cam (not shown).

Further, when the leading end of the recording medium 5 abuts on the terminal position regulating member 14, the leading end portion is fastened on the surface of the rotary drum 13 in a predetermined timing by an sucking air force through an orifice 16 and a tube 18 communicated with a vacuum pump (not shown) under the control of the controlling device 11 based on a signal generated by the sensor (not shown). After that, the recording medium 5 is cut into a desired length needed for recording by a cutting device 12, and the recording medium 5 cut is closely wound around the rotary drum 13 over the entire length thereof.

Next, when the recording medium 5 closely wound around the rotary drum 13 has been rotated until a position where electrification devices 24, 25 are disposed, the recording medium 5 is uniformly electrified by the electrification devices 24, 25.

After the recording medium 5 electrified is exposed every line on the basis of predetermined information by exposing means comprising a polygon mirror 27, a semiconductor laser 28, a lens system 29 and reflection mirrors 30, 31, the recording medium 5 undergoes a pre-wet treatment by a pre-wet device "P" provided in a lower level.

A pre-wet liquid is held in a vessel 35 fixed on a bottom plate 47, and is supplied to a dispenser 36*a* through a tube 36. A whole range of the exposed portion formed on the recording medium 5 is coated with the pre-wet liquid being poured from plural orifices (not shown) provided on the dispenser 36*a*. The excess pre-wet liquid dropped into a tank 34 is recovered in the vessel 35 through a tube 37.

The exposed portion of the recording medium 5 is transferred to a developing treatment mechanism which is a main part of the present invention.

Figure 5:
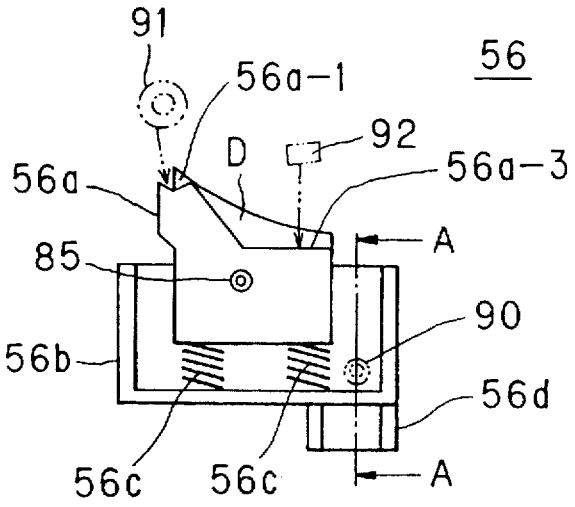
FIG. 5 is a side sectional view of a developing device.
Figure 6:
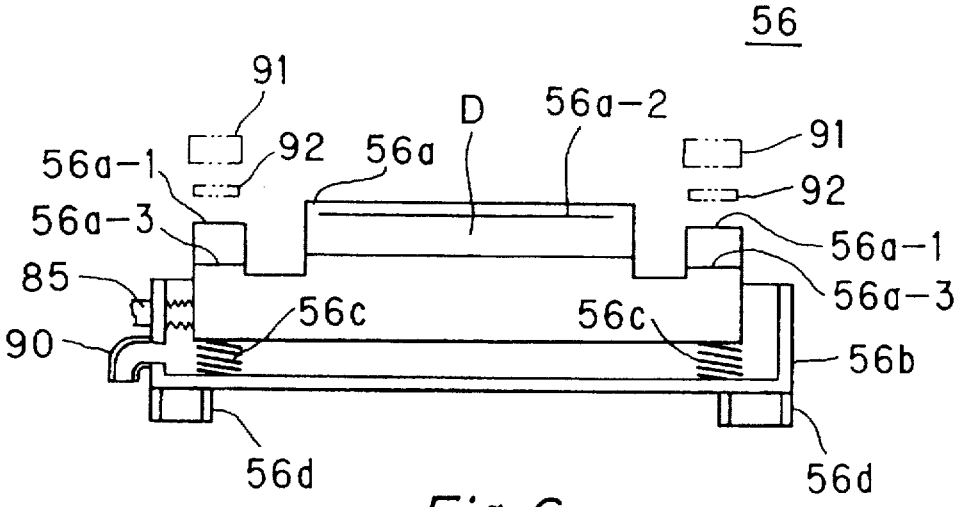
FIG. 6 is an A—A sectional view of FIG. 5.

Next, a description is given of the developing treatment mechanism in reference to FIGS. 5 and 6.

FIG. 5 is a side sectional view of a developing device.

FIG. 6 is an A—A sectional view of FIG. 5.

In FIGS. 4 and 5, a developing device 56, one of developing devices 52 through 56, is selectively situated at a developing position beneath the rotary drum 13 being displaced upward.

These developing devices 52 through 56 have the same construction as each other, thus a description is given of the developing device 56 as an example.

A developing device 56 generally comprises an accommodating section 56*b* and a developing dish 56*a* supported by springs 56*c*, 56*c* in the accommodating section 56*b* as shown in FIGS. 5 and 6. On a bottom of the accommodating section 56*b*, a pair of receiving sections 56*d*, 56*d* are provided at both sides of the bottom for retaining rollers 68*c* (second rollers; see FIG. 7(A)) of L-letter arms 68 as mentioned hereinafter.

In the middle of the developing dish 56*a*, a concave surface "D" is formed so as to have approximately the same radius curvature and the same width as those of the rotary drum 13. On both sides of the developing dish 56*a*, there is respectively provided a protruding member having an abutting section 56*a*-1 having a V-letter shape on a top end thereof and an engaging portion 56*a*-3 in a middle position. On one side surface of the developing dish 56*a*, there is provided a tube 85 (81–84 for developing devices 52–55) having a bellows to allow rocking motion of the developing device 56 provided in the accommodating section 56*b* due to actions of the springs 56*c*, 56*c*.

The liquid developer supplied from the tube 85 flows out from a long slit 56*a*-2 formed on a top face of the concave surface "D" in a width direction of the rotary drum 13 and flows over the whole concave surface "D". The liquid developer dropped into the accommodated section 56*b* is recovered in the vessel 46 (42–45 for developing devices 52–5) through a tube 90 (86–89 for developing devices 52–55).

The liquid developer is circulated under control of the controlling device 11. The reason is as follows.

In the developing process, the electrification, the exposure, the pre-wet and the developing are respectively performed at a predetermined time interval, in other words, they are subjected to a time control. On the other hand, the liquid developer requires an adequate time to be supplied to the long slit 56*a*-2 because it flows at a comparatively small flow rate. Thus, this prevents a timely supply of the liquid developer in the developing process. Further, the liquid developer includes resin so as to stabilize the image, thus the liquid developer tends to become sticky by being dried. Therefore, the liquid developer is always circulated to prevent itself from drying. Incidentally, the flow rate thereof is controlled by a regulating valve (not shown) so as to limit the flowing amount of the liquid developer, otherwise, the image produced would be degraded by an image tearing (blurring) phenomenon.

Each of the developing devices 52–56 is mounted on a pair of parallel transferring members 50 made of, for instance, chains or belts, and is transferred to a position just over an up-down displacing device.

Figure 7A:
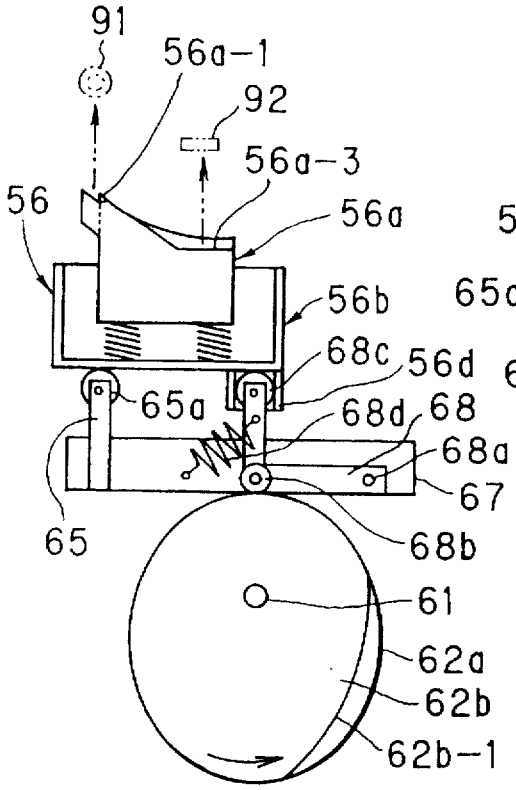
FIG. 7(A) is a sectional side view showing an initial state where the developing device is supported by arms.
Figure 7B:
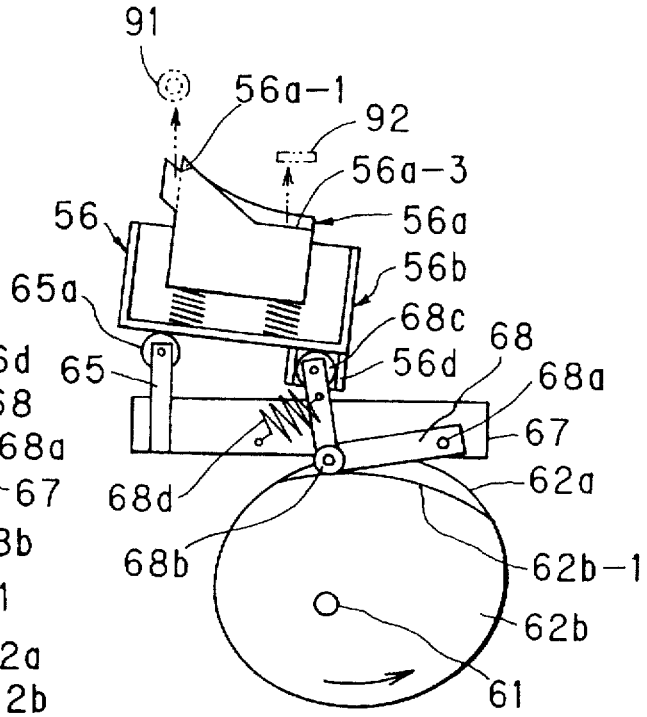
FIG. 7(B) is a sectional side view showing a state where the developing device is declined.

Next, a description is given of the up-down displacing device in reference with FIGS. 7(A) and 7(B).

FIG. 7(A) is a sectional side view showing an initial state where the developing device is supported by arms.

FIG. 7(B) is a sectional side view showing a state where the developing device is declined.

The reference character 62a designates a first cam for displacing the developing device 56 upward and downward, and 62b a pair of second cams, each coaxially provided in respective outsides of the first cam 62a for declining the developing device 56.

Referring to FIG. 4, these first cam 62a and second 62b are rotatably provided on a coaxial cam shaft 61 fixed by a support member 60, and a cam surface of the first cam 62a always abuts on a bottom of a platform 67. At a bottom of the platform 67, guide sections 63, 64, each having an engage hole, are provided. Thus, the substrate 67 is allowed to move upward and downward following a rotational motion of the first cam 62a by causing guide shafts 58, 59 fixed on a base plate 57 to pass through the engaging holes of the guide sections 63, 64.

Referring to FIG. 7(A), at one end of respective side surfaces of the platform 67 in the drum width direction, an arm 65 equipped with a first roller 65a is fixedly provided, respectively. Further, at another end of the respective side surfaces of the platform 67, an L-letter arm 68 is rotatably provided at a shaft 68a. At one end of the L-letter arms 68, a second roller 68c is provided, and at a bent portion of the L-letter arm 68, a third roller 68b is rotatably provided. Further, a spring 68d is provided to press always the third roller 68b on the cam surface of the respective second cams 62b.

The operation of this up-down displacing device is as follows.

When the developing device 56 is transferred right above the up-down displacing device by the parallel transferring member 50, one end portion of the bottom of the developing device 56 is supported by the first roller 65a and the other end portion where the receiving section 56d is provided, is supported by the second roller 68c by causing the second roller 68c to engage with the receiving section 56d. At that time, the cams 62a and 62b are rotated in a position where the receiving section 56d is able to receive the second roller 68c. This is controlled by the controlling device 11 on the basis of information from an encoder (positioning sensor) provided on the cam shaft 61. In this state, the developing device 56 is not inclined as shown in FIG. 7(A).

When the cams 62a, 62b are rotated in a counterclockwise direction from this position, the platform 67 is displaced upward along with the developing device 56 by the cam surfaces of the cams 62a, 62b. On the way, as shown in FIG. 7(B), when the third roller 68b begins to abut on a curved section 62b-1 of the second cam 62b, the other end of the platform 67 is declined downward because the L-letter arm 68 is displaced downward by the force of the spring 68d. Thus, the developing device 56 is also declined. When the platform 67 with the developing device 56 is further forwarded upward as being declined, one of the abutting portions 56a-1 of the developing dish 56a abuts on an engaging member 91 having a bearing structure. The engaging member 91 is fixed on a base plate 33. Thus, the developing dish 56a is rotated in a counterclockwise direction so as to change the declined attitude thereof to be horizontal accordingly with the rotation of the L-letter arm 68 in a clockwise direction around the shaft 68a by causing the third roller 68b to be contacted with the curved section 62b-1 of the second cam 62b.

At a final stage of abutting on the curved section 62b-1 of the second cam 62b, the attitude of the developing dish 56a becomes approximately horizontal. At the same timing, the engaging portion 56a-3 of the developing dish 56a is engaged with an engaging member 92 provided on the base plate 33. Thus, the developing dish 56a is securely maintained in a horizontal level. The cams 62a, 62b are further rotated so as to displace the substrate 67 upward, however, the developing dish 56a is prevented from displacing by causing the engaging portion 56a-3 to engage with the engaging member 92. The displacement of the substrate 67 is absorbed by the spring 56c as a displacement of compression, by which a pressing force is given to the developing dish 56a. The developing position of the developing dish 56a is determined at an uppermost position thereof where the curved surface "D" of the developing dish 56a approaches most closely to the surface of the rotary drum 13.

Figure 8A:
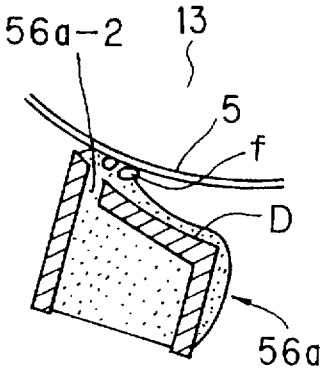
FIGS. 8(A)–8(C) are partial sectional views showing operations of both the developing dish and the rotary drum for explaining the bubble removing mechanism.
Figure 8B:
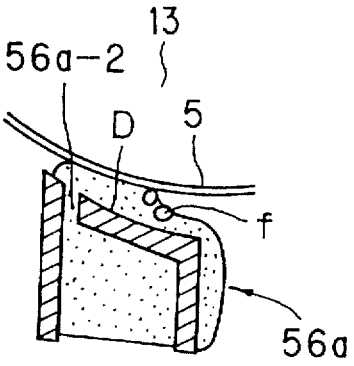
Figure 8C:
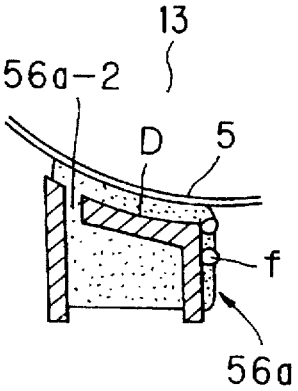

Next, a description is given of a reason why the bubbles "f" generated in the liquid developer are removed by the above construction of the present invention in reference with FIGS. 8(A)–8(C).

FIGS. 8(A)–8(C) are partial sectional views showing operations of both the developing dish and the rotary drum for explaining the bubble removing mechanism.

As shown in FIG. 8(A), when the recording medium 5 begins to contact with the liquid developer (at a timing when the abutting section 56a-1 begins to abut on the engaging member 91), there are generated some bubbles "f".

These bubbles "f" have small diameters because the contact ing area of the liquid developer and the recording medium is small. At this moment, a space between the recording medium 5 and a part of the curved surface of the developing dish 56a is filled with the liquid developer. After that, as shown in FIG. 8(B), when the whole concave surface "D" of the developing dish 56a displaced upward so as to approach to the recording medium 5, the liquid developer containing the bubbles "f" flows acceleratively downward. At the final position of the concave surface "D", as shown in FIG. 8(C), a uniform space formed between the recording medium 5 and the whole concave surface "D" is filled with the liquid developer having no bubbles. In this state, the developing of the latent image on the recording medium 5 is performed.

Therefore, according to the first embodiment of the present invention, the bubbles "f" generated in the liquid developer are prevented from attaching on the recording medium 5 upon developing. This contributes to obtaining an excellent quality image by preventing the stripes having light and shade from occurring in the reproduced image.

In this developing process, the maximum declined angle of the developing dish 56a is considered to be about 10 degrees taking account of rotational speed of the developing dish 56a and a flow of the bubbles, as mentioned hereinafter.

After that, the recording process is followed in the same way as mentioned in the prior art. In the case of multiple color process, after one cycle of recording process, the same cycle of recording process is repeated for other colors.

[A second embodiment]

Next, a description is given of a second embodiment of the present invention.

A feature of this embodiment lies in a contacting timing of the liquid developer with the recording medium 5 and a returning operation of declined attitude of the developing device 56.

Figure 9:
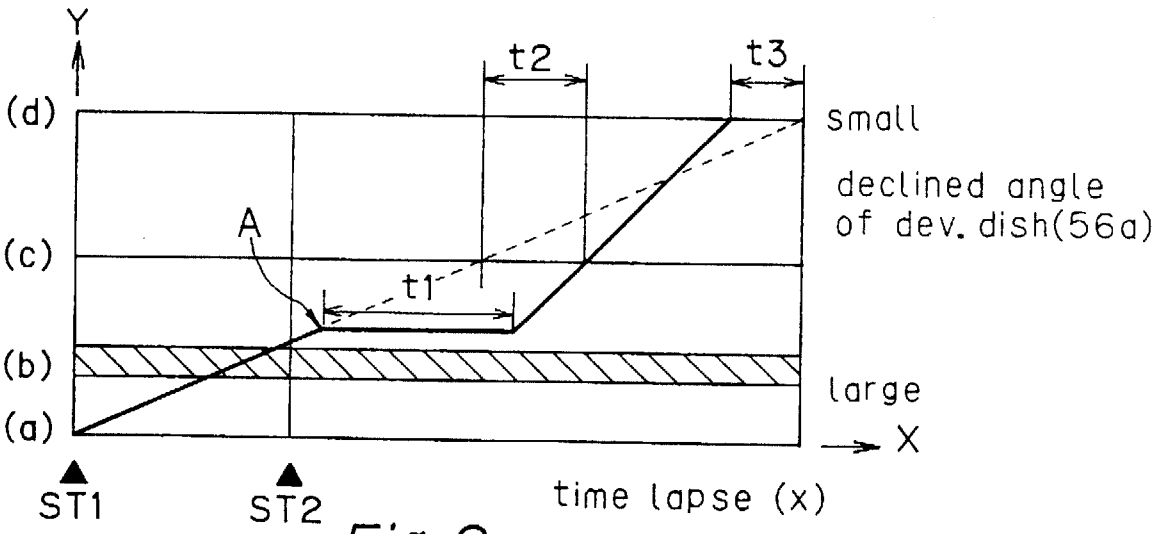
FIG. 9 is a chart for explaining a returning operation to a horizontal level from the maximum declined angle of the developing device in the second embodiment.

FIG. 9 is a chart for explaining a returning operation to a horizontal level from the maximum declined angle of the developing device 56 in the second embodiment.

In FIG. 9, the X axis designates a time lapse and the Y axis designates a degree of the declined angle of the developing dish 56*a*, wherein a state (a) corresponds to a starting position where the developing dish 56*a* is going to be returned to a horizontal level after the rising operation of the platform 67 has been completed and the developing dish 56*a* has been declined at the maximum; a state (b) corresponds to a contacting area of the recording medium 5 and the liquid developer flowing over the developing dish 56*a;* a state (c) corresponds to a limiting position where bubbles "f" are impossible to be removed; a state (d) corresponds to a position where the declined angle of the developing dish 56*a* has returned to the horizontal level; a state "ST1" corresponds to a start point of returning, and a state "ST2" corresponds to a start point of removing the bubbles.

In this embodiment, at the uppermost position shown with the state (a) of the developing device 56 or the platform 67, the liquid developer has not contacted with the recording medium 5 yet. In other words, in order not to contact the liquid developer with recording medium 5, the declined angle of the developing dish 56*a* is made larger compared with the declined angle thereof in the state shown in FIG. 8(A), for instance. This state is a starting position of returning to a horizontal level. Otherwise, the surface of the liquid developer will begin to roll with rising of the liquid developer, and attaches to the recording medium 5 with a large force to generate bubbles.

From the uppermost position (a) of the platform 67 where the liquid developer does not contact with the recording medium 5, the liquid developer gradually begins to contact with the recording medium 5 by causing the developing device 56 to be displaced or to be returned in a horizontal level. At this stage, when the bubbles "f" are generated in the liquid developer, the bubbles "f" begin to be washed away gradually by the liquid developer. Until coming to the position (b), the developing device 56 is displaced at a slow constant velocity.

After that, at the time when the declined angle of the developing device 56 comes to become a point "A" as shown in FIG. 9, the returning operation of the developing device 56 is stopped and the declined angle of the developing device 56 is held as it is for a predetermined time period "t1".

In this state, the spacing between the concave surface "D" of the developing dish 56*a* and the recording medium 5 is filled with the liquid developer, and the developing dish 56*a* remains declined at a predetermined angle so as to wash away the bubbles easily.

After that, the developing device 56 is further displaced to return in the horizontal level, wherein the velocity of returning operation is higher than that of the access operation before the point "A". As a result, it is possible to give an adequate time "t2" to securely remove or to wash away the bubbles and to shorten an overall time needed to return the developing dish to the horizontal level by a time "t3" compared with the case where the velocity of the returning operation is continuously constant (shown with a dotted line).

The control of the velocity of the returning operation is performed by changing the shape of the cam 62*b*-1 shown in FIG. 7(B).

Further in this embodiment, during the holding time "t1" for a predetermined angle, the developing device 56 may be vibrated so as to wash away the bubbles readily. This can be attained by forming small dimples on the surface of the cam 62*b*-1.

Further, in this embodiment, the description is given of an example where the developing dish 56*a* is declined around an axis parallel to the shaft of the rotary drum 13, however, it is possible to decline the developing dish 56*a* in a direction oblique to the shaft of the rotary drum 13 as shown in FIG. 10 (A).

Figure 10B:
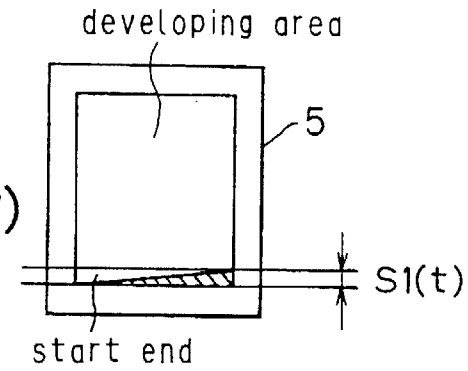
FIG. 10(B) is a schematic plan view of the recording medium.
Figure 10A:
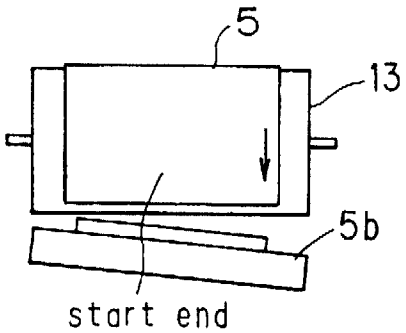
FIG. 10(A) is a schematic front view for explaining another embodiment, wherein the developing dish is declined in a direction oblique to the shaft of the rotary drum.

FIG. 10(A) is a schematic front view for explaining another embodiment, wherein the developing dish 56*b* is declined in a direction oblique to the shaft of the rotary drum.

FIG. 10(B) is a schematic plan view of the recording medium.

In this case, a dipping timing of the recording medium 5 into the liquid developer may be different between the most left hand end and the most right hand end of a developing area in the recording medium 5 by a time lag t"t" due to the decline of the end of the recording medium 5 to the surface of the liquid developer by a length of "S1" as shown in FIG. 10(B).

[A third embodiment]

Figure 11:
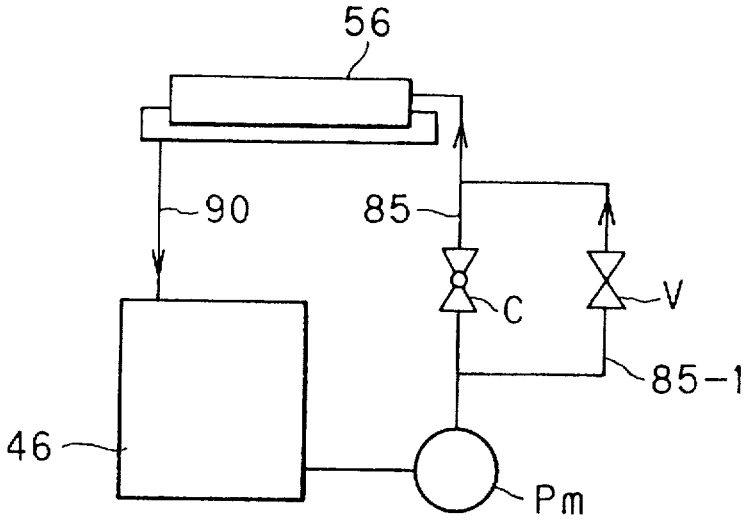
FIG. 11 is a diagram showing a flow path of the liquid developer in the third embodiment of the present invention.

A description is given of a third embodiment of the present invention in reference to FIG. 11.

FIG. 11 is a diagram showing a flow path of the liquid developer in the third embodiment of the present invention.

The developing devices 52–56 respectively have the same flow path, thus the description is given of an example of the developing device 56 for simplicity.

The flow path of the developing device 56 comprises a vessel 46 for storing the liquid developer, a pump "Pm" for supplying the liquid developer, a cock "C" having a fixed structure for controlling a constant flow rate of the liquid developer, an electromagnetic valve "V" for variably controlling the flow rate of the liquid developer, and the developing device 56. They are connected by tubes 85, 85-1 and 90 as shown in FIG. 11. In particular, the valve "V" is connected to the cock "C" in parallel to allow a control of the flow rate thereof, which is a feature of this embodiment of the present invention.

Upon operation, the electromagnetic valve "V" is opened under the control of the controlling device 11 by turning "on" a power switch, whereby both the liquid developer through the valve "V" and the liquid developer through the cock "C" are combined to each other. Thus, a fairly large amount of the liquid developer can be supplied to the developing device 56.

When the developing device 56 has been securely set at the uppermost position, the electromagnetic valve "V" is shut. After that, the developing begins. This timing is controlled by the controlling device 11 on the basis of a detecting signal generated by an encoder (not shown) for detecting a cam position corresponding to the uppermost position of the developing device 56.

Therefore, according to this embodiment, the large amount of the liquid developer is supplied into the developing device 56 before developing, thus even if bubbles develop, it is possible to remove the bubbles securely because the liquid developer flows with a large force. In addition, upon developing, the flow rate of the liquid developer is suppressed, thus the image tearing (blurring) phenomenon can be prevented.

In the embodiments (first to third) mentioned in the foregoing, the developing dish 56*a* is supported in the accommodating section 56*b* through the coil springs 56*c*, however, it is possible to use an elastic force of a leaf spring on which the developing dish 56*a* is integrally provided in the accommodating section 56*b* instead of the coil springs 56*c*.

Further, it is possible to employ a bearing provided on the side of the developing dish 56*a* instead of providing it on the side of the engaging member 91.

As mentioned in the foregoing, according to the present invention, it is possible to remove the bubbles generated in the liquid developer upon developing, thus it is able to obtain an excellent image without lines having light and shade due to the bubbles.

[A fourth embodiment]

The inventors of the present invention observed in detail the surface condition of the liquid developer "L" on the concave surface "D" of the developing dish 56*a* to clarify a generation mechanism of the bubbles.

Figure 12A:
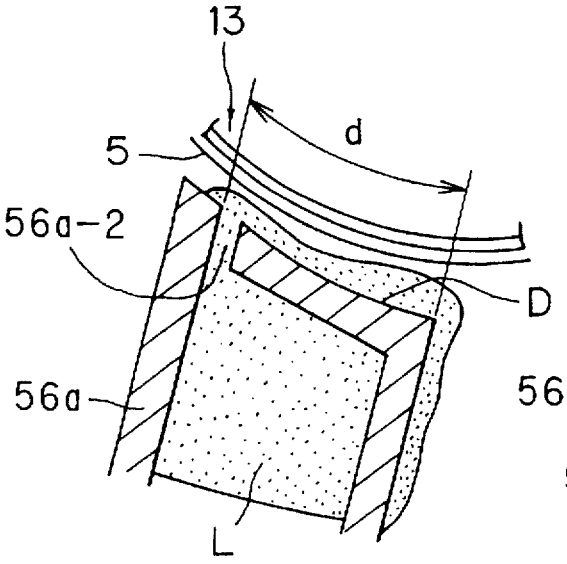
FIGS. 12(A) and 12(B) are sectional side views showing surface shapes of the liquid developer in dishes.
Figure 12B:
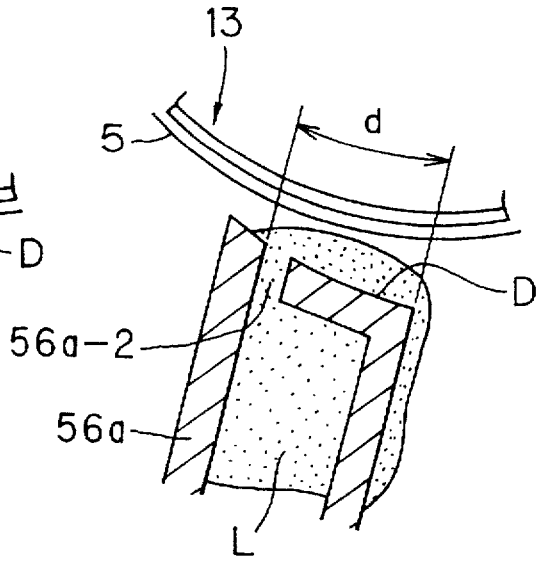

FIGS. 12(A) and 12(B) are sectional side views showing surface shapes of the liquid developer in dishes.

As a result, the inventors discovered a fact that the surface of the liquid developer "L" flowing over the concave surface "D" has a concave shape at the middle thereof as shown in FIG. 12(A). It is considered that the concave shape of the surface thereof causes bubbles easily by enveloping the air in the concave when the liquid developer "L" contacts with the recording medium 5 wound around the rotary drum 13.

As primary factors to determine the surface shape of the liquid developer "L" , there may be considered a flowing force (flow rate per a unit time) of the liquid developer from the supplying long slit 56*a*-2, a surface tension of the liquid developer, and a shape of the developing dish 56*a*.

Therefore, the present inventors studied the shape of the developing dish 56*a* capable of maintaining the flat or convex surface of the liquid developer "L".

As a result of the study, they have found that the surface of the liquid developer "L" is subjected to a length "d" (referred to as a developing length) measured from the supplying slit 56*a*-2 to an end of the developing dish 56*a* from which the liquid developer "L" falls.

Namely, the shorter the developing length "d" becomes, the more easily the convex surface of the liquid developer "L" can be maintained as shown in FIG. 12(*b*). Further it is experimentally confirmed that in order to maintain the flat surface thereof, the upper limit value of the developing length "d" has to be at most 15 mm, and the values below 15 mm thereof allow to maintain approximately the convex surface of the liquid developer "L".

Furthermore, it is confirmed that the generation of the bubbles is extremely suppressed by causing the surface shape of the liquid developer "L" to maintain convex when the liquid developer contacts with the surface of the recording medium 5.

In this embodiment, the supplying slit 56*a*-2 has a shape having a width of 1 mm and a length of 327 mm, and the liquid developer "L" is supplied at the flow rate of 2 cc/sec. There is employed a liquid developer "L" including isoparaffine, pigment, resin and electric charge agent dispersed with one another.

As mentioned in the foregoing, in order to maintain the surface shape of the liquid developer convex, it is effective to cause the developing length "d" to be shorter. However, it is necessary to adjust the density of toner and an amount of electric charge included in the toner of the liquid developer "L" so as to secure a desired density thereof taking account of an inverse proportional relation between the developing time of the recording medium 5 and the developing length "d".

In this embodiment, it is considered that the preferable range of the developing length "d" is to be 5 to 15 mm taking account of the above conditions.

In this embodiment, a description is given of an example of the image recording apparatus in which the declined angle of the developing dish 56*a* is returned to the horizontal level after the developing dish 56*a* being declined is brought to the vicinity of the rotary drum 13.

But this invention is not limited to this embodiment. Namely, upon positioning the developing dish 56*a* to the developing position, it is effective to adopt the concept of this invention to an image recording apparatus where the developing dish 56*a* is simply displaced upward and downward without causing the developing dish 56*a* to be declined.

As mentioned in the foregoing, according to the fourth embodiment of the present invention, the surface shape of the liquid developer can be made flat or convex by establishing dimensions of the developing dish in a section in parallel to a plane perpendicular to the shaft of the rotary drum, thus it is possible to perform excellent developing by effectively suppressing the generation of the bubbles when the liquid developer is contacted with the recording medium in a process of coming to a state where the developing dish faces to the rotary drum.

[A fifth embodiment]

Figure 13:
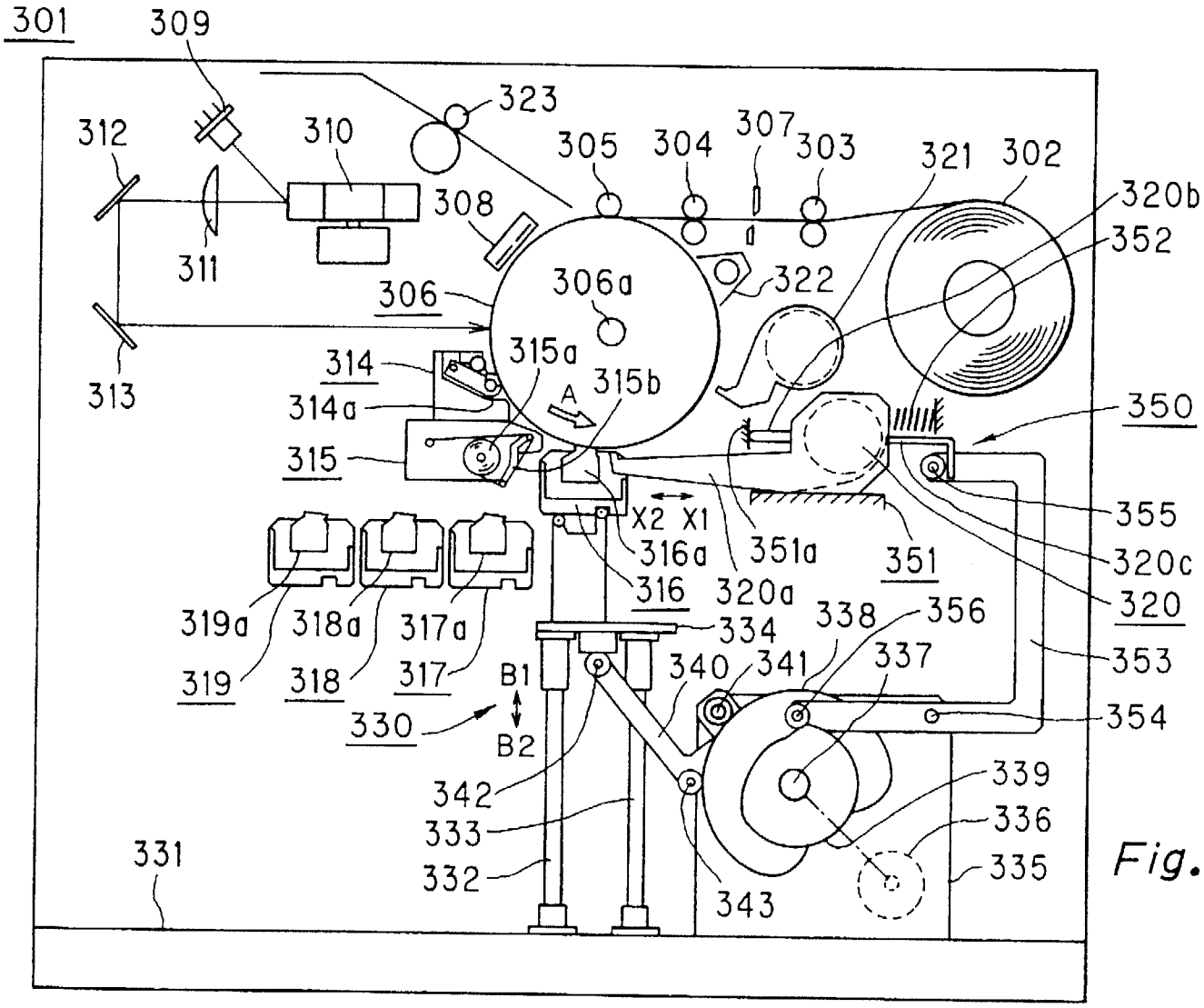
FIG. 13 is a side view schematically showing a first embodiment of the excess liquid developer removing device of the present invention.
Figure 14A:
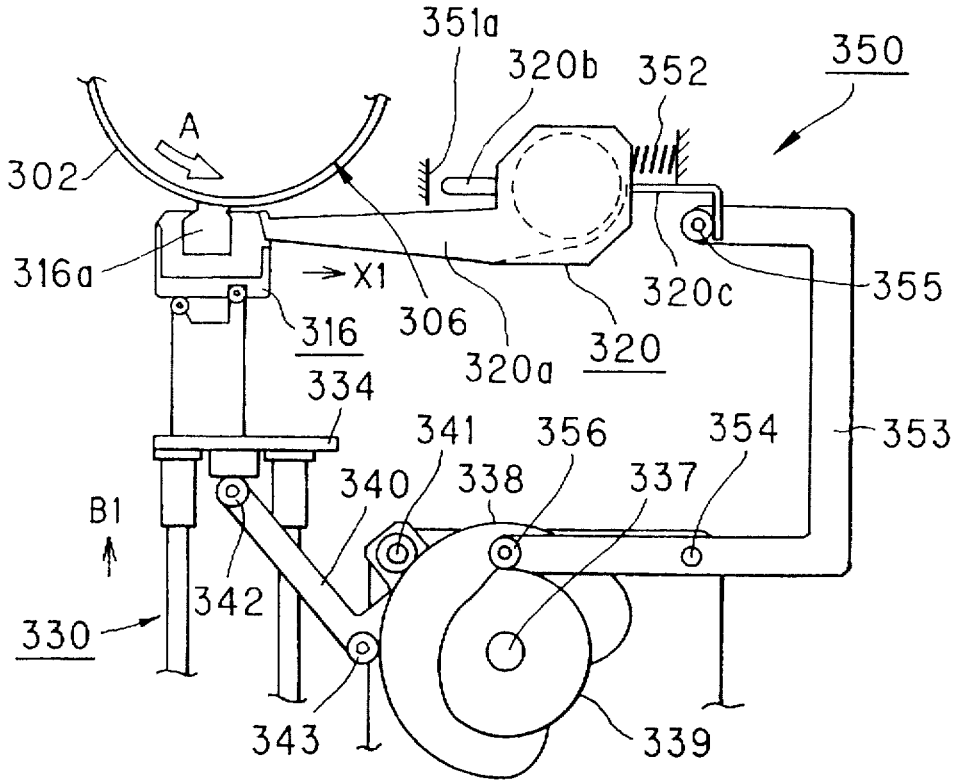
FIGS. 14(A) and 14 (B) are side views for explaining operations of the first embodiment of the excess liquid developer removing device shown in FIG. 13.
Figure 14B:
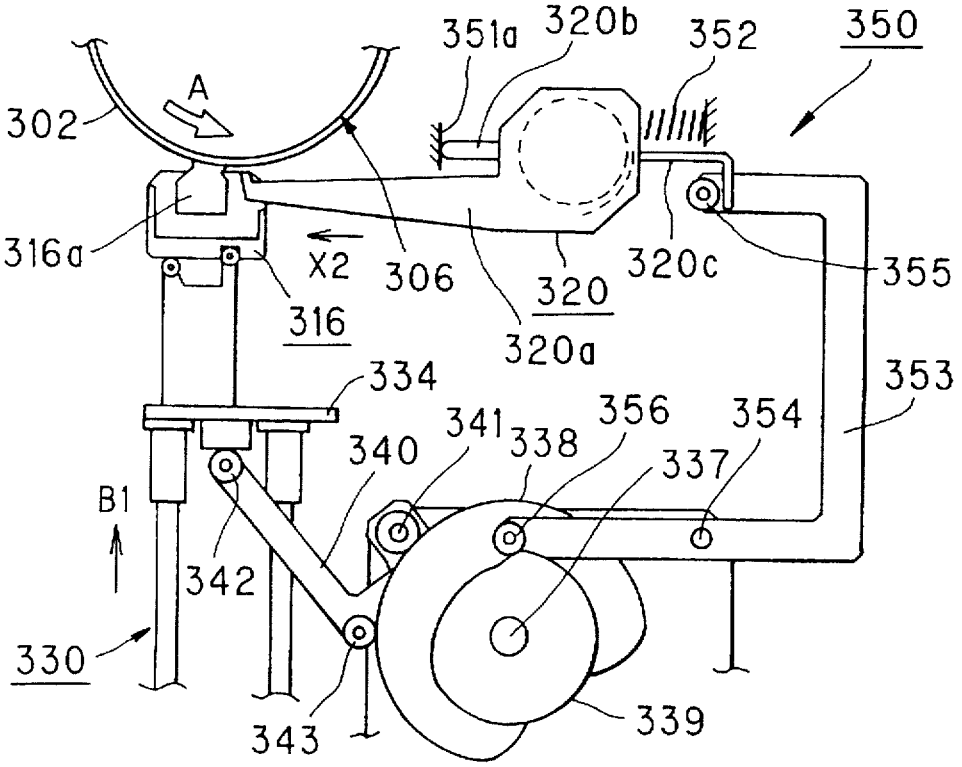
Figure 15:
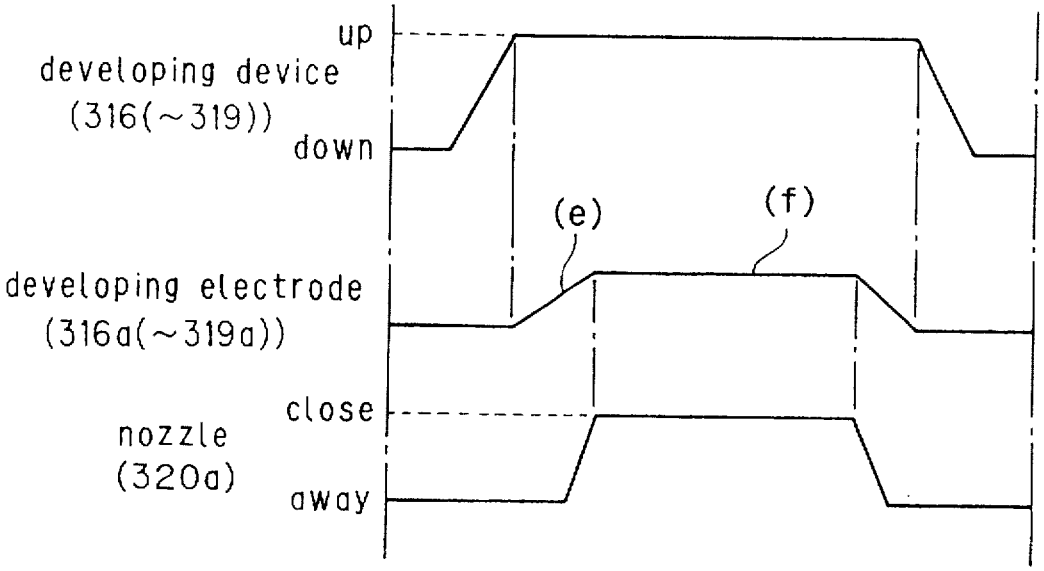
FIG. 15 is a timing chart of each of main constructive components in a first embodiment of the excess liquid developer removing device.
Figure 16:
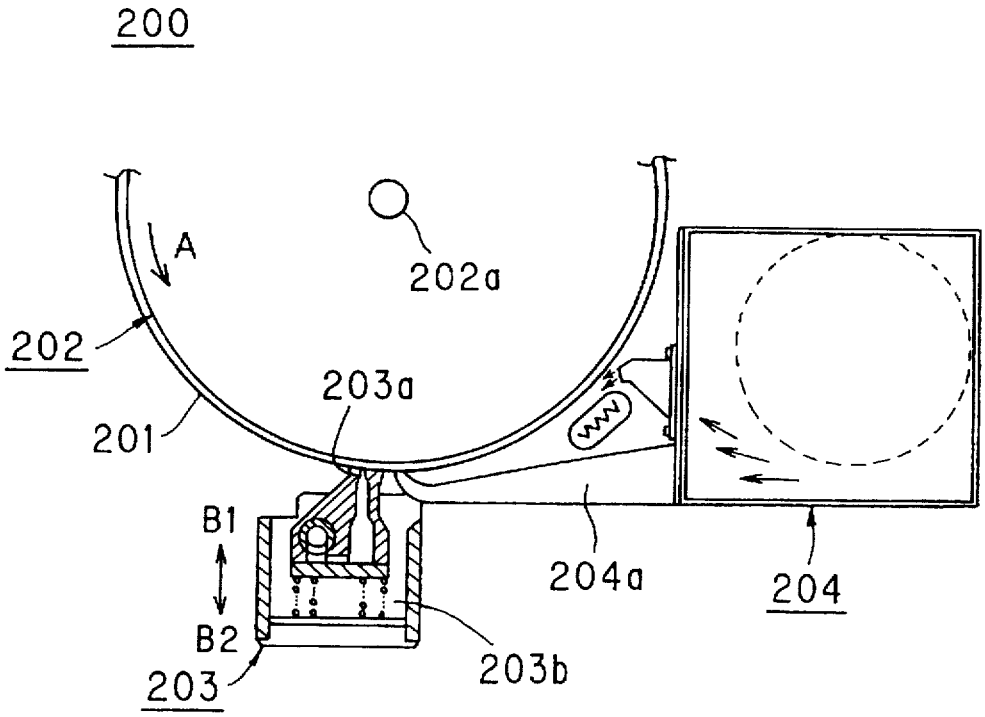
Fig.16 Prior Art
FIG. 16 is a side sectional view schematically showing an excess liquid developer removing device of the prior art.

A description is now given of a fifth embodiment of the image recording apparatus, in particular, regarding an excess liquid developer removing device of the present invention with reference to FIGS. 13 through 15.

FIG. 13 is a side view schematically showing a first embodiment of the excess liquid developer removing device of the present invention.

FIGS. 14(A) and 14 (B) are side views for explaining operation of the first embodiment of the excess liquid developer removing device shown in FIG. 13.

FIG. 15 is a timing chart of each of main constituting components in a first embodiment of the excess liquid developing device.

Referring to FIG. 13, an excess liquid developer removing device 301 of a first embodiment is constructed to be applied to a wet type photographic apparatus. In the excess liquid developer removing device 301, a photosensitive medium 302 is mounted in a rolled state. The photosensitive medium 302 is fed by two pairs of rollers 303, 304 toward a rotary drum 306 and is integrally transferred along with the rotary drum 306 in a counterclockwise direction as shown in an arrow A in such a manner that the photosensitive medium 302 is fixed on the surface of the rotary drum 306 by a sucking operation of a vacuum device (not shown) installed in the rotary drum 306 in cooperation with a pressing operation of a pinch roller 305. After that, the photosensitive medium 302 is cut at a predetermined length by a cutter 307 disposed between the rollers 303 and 304.

Further, the photosensitive medium 302 transferred integrally along with the rotary drum 306 is uniformly electrified by an electrification device 308 disposed in the vicinity of an upstream position of the photosensitive medium 302 in cooperation with rotation of the rotary drum 306.

Further, an image signal corresponding to an original image is emitted from a semiconductor laser 309 in a form of modulated laser beam. The laser beam of the image signal is scanned on the photosensitive medium 302 in a direction of the axis 306*a* of the rotary drum 306 for every line of image by a polygon mirror 310. Thus, an electrostatic latent image corresponding to the original image is recorded on the photosensitive medium 302 by causing the photosensitive medium 302 to be exposed to the laser beam passing through a lens 311 and reflectors 312, 313 disposed in this order.

A pre-bath device 314 for avoiding uneven color density in developing is provided in the vicinity of a downstream position of the photosensitive medium 302 with respect to the electrification device 308. Pre-bath liquid supplied from a liquid supply source (not shown) is coated on the surface of the photosensitive medium 302 so as to cover the electrostatic latent image recorded thereon, by being poured on an outer surface of a roller 314*a*.

An excess liquid developer remover 315 is provided in the vicinity of a downstream position of the photosensitive medium 302 with respect to the pre-bath device 314. The excess liquid developer remover 315 has a function of removing the excess liquid developer remaining on the distal end of the photosensitive medium 302 in the midst of developing process by contacting with a cleaning member 315*a* which is wound in a rolled state and supported by a movable arm 315*b*, as mentioned hereinafter.

A developing device 316, for instance, selected from a plurality of developing devices 316~319 is disposed movably up and down (in directions shown with arrows B1, B2) beneath the rotary drum 306 in the vicinity of a downstream position of the photosensitive medium 302 with respect to the excess liquid remover 315.

These developing devices 316~319 are provided with elongated developing electrodes 316*a*~319*a* therein disposed parallel to or along the shaft 306*a* of the rotary drum 306. These developing devices 316~319 include a yellow (Y) developing device 316, a magenta (M) developing device 317, a cyan (C) developing device 318 and a black (B) developing device 319, each provided for supplying one of color liquid developers (Y), (M), (C) and (B) to visualize one of the color electrostatic latent images recorded in the photosensitive medium 302 upon developing. In FIG. 13, one of them, i.e., the yellow developing device 316, is selectively mounted on a base 334 as mentioned hereinafter.

Upon developing the photosensitive medium 302 corresponding to each of electrostatic latent images of the color components, at first, the yellow (Y) developing device 316 is raised beneath the rotary drum 306 by using a developing device transferring mechanism 330 so that the electrostatic latent image for yellow is developed by causing the liquid developer flowing from the electrode 316*a* to contact with the photosensitive medium 302. After that, every one revolution of the rotary drum 306, magenta (M), cyan (C) and black (B) developments are performed in order in the same way, by using the magenta developing device 317, the cyan developing device 318 and the black developing device 319, respectively.

Further, a blower 320 is provided in the vicinity of a downstream position of the photosensitive medium 302 with respect to one of the developing devices 316 (~319 ) that is raised beneath the rotary drum 306. A blower 320 having a nozzle 320*a* for blowing the air is movably provided so as to move in horizontal directions shown with arrows X1 and X2. The nozzle 320*a* of the blower 320 is displaced in close proximity to the developing electrode 316*a* (~319*a*) upon developing by nozzle moving means 350, which is one of features of the excess liquid developer removing device of the present invention. The nozzle moving means 350 for moving the nozzle 320*a* will be mentioned hereinafter along with developing device transferring means 330.

Further, in the vicinity of a downstream position of the photosensitive medium 302 with respect to the nozzle 320*a* of the blower 320, a dryer 321 and a discharger 322 are respectively provided for drying the photosensitive medium 302 undergone the development and for discharging the electric charges remaining on the surface thereof. Furthermore, a pair of rollers 323 are provided for discharging the photosensitive medium 302 from the apparatus in an upper left-hand side as shown in FIG. 13.

Next, a description is given of the developing device transferring means 330 and the nozzle moving means 350 which are main parts of the present invention.

The developing device moving means 330 comprises a plurality of guide shafts 332, 333 (only two guide shafts are shown) provided on a main base 331 and a mounting base 334 mounted slidingly up and down on the plurality of guide shafts 332, 333 for selectively mounting one of the developing devices 316~319 thereon.

Further, a cam supporting plate 335 is erected from the main base 331. On the cam supporting plate 335, there are provided a motor 336 as a driving source and a rotatable shaft 337 driven through reduction gears (not shown). A developing device moving cam 338 and a nozzle moving cam 339 are respectively fixed on the rotatable shaft 337 in a predetermined angular relation.

Further, a developing device moving lever 340 having a V-letter shape is rotatably supported at a distal end thereof by a shaft 341 provided on the cam supporting plate 335, and the developing device moving lever 340 is equipped with a cam follower 343 at a center portion to contact with a developing device moving cam 338 and a roller 342 at another end thereof to contact with the mounting base 334. When the developing device moving cam 338 is rotated, the cam follower 343 of the developing device moving lever 340 swings at the shaft 341 by causing the cam follower 343. Thus, the developing device mounting base 334 mounting the developing device 316 (~319) moves up and down being driven by the roller 342 provided on the another end of the developing device moving lever 340.

The nozzle moving means 350 is constructed in such a manner that the blower 320 having the nozzle 320*a* is able to move on a blower base 351 in horizontal directions shown with arrows X1, X2 so as to allow the nozzle 320*a* of the blower 320 to approach to the developing electrode 316*a* (~319*a*) disposed in the developing device 316 (~319).

Further, the blower 320 is provided with a positioning pin 320*b* at one side thereof in the vicinity of the rotary drum 306 and with an L-letter shaped engaging lever 320*c* at another side opposite to the positioning pin 320*b*. Thus, the distal end of the nozzle 320*a* of the blower 320 is positioned in close proximity to the electrode 316*a* of the developing device 316 in such manner that the another side of the blower 320 is pushed in a direction of the rotary drum 306 by a compression spring 352 and the distal end of the positioning pin 320*b* abuts on a stopper surface 351*a*.

Further, a nozzle moving lever 353 having a U-letter shape is rotatably supported by a shaft 354 provided on the cam supporting plate 335. The nozzle moving lever 353 is provided with a roller 355 at an distal end thereof to engage with the inner surface of the L-letter shaped engaging lever 320*c* and with a cam follower 356 at another distal end thereof to contact with the nozzle moving cam 339.

When the nozzle moving cam 339 is integrally rotated along with the developing device moving cam 338, the cam follower 356 provided at the distal end of the nozzle moving lever 353 is rotated around the center of the shaft 354 along the nozzle moving cam 339. Thus, the nozzle 320*a* of the blower 320 can move forward and backward with respect to the electrode 316*a* (~319*a*) disposed in the developing device.

As mentioned in the foregoing, in the first embodiment of the excess liquid developer removing device, the blower 320 is constructed so as to move integrally with the nozzle 320*a*. However, as another embodiment, it is possible to separate a nozzle (not shown) from a blower (not shown) itself as a source of the air by connecting the nozzle with the blower itself by means of a flexible tube. Thus, only the nozzle is able to move forward and backward with respect to the developing electrode 316*a* (~319*a*).

As mentioned in the foregoing, the developing device transferring means 330 and the nozzle moving means 350 are constructed in such a manner that the developing device moving cam 338 and the nozzle moving cam 339 are respectively provided on the same output shaft (rotatable shaft) 337 driven by the motor 336 as the same driving source in a predetermined phase relation. Thus, the timing between the developing device 316 (~319) and the nozzle 320*a* is securely harmonized, which contributes to an increment of reliability and reduction of cost of the excess liquid developer removing device.

Next, referring to FIGS. 14(A), 14(B) and 15, an operation of the excess liquid developer removing device 301 is explained along with the nozzle moving means 350. In FIG. 15, a state (e) designates an attitude controlling state of the developing electrode 316*a* (~319*a*), and a state (f) designates developing state of the photosensitive medium 302.

As shown in FIGS. 14(A) and 15, when the developing device moving cam 338 and the nozzle moving cam 339 are integrally rotated, the developing device 316 for Y color is raised beneath and in close proximity to the rotary drum 306 in cooperation with a rotational operation of the developing device moving lever 340 caused by the rotation of the developing device moving cam 338. After the developing device 316 is raised, the developing electrode 316*a* in the developing device 316 is controlled so as to have a predetermined angle during an adequate time by an attitude control means (not shown) as mentioned in the foregoing. Of course, the developing moving cam 338 and the nozzle moving cam 339 are being integrally rotated during the attitude control of the developing electrode 316*a*.

On the other hand, while the developing electrode 316*a* is being controlled, the nozzle 320*a* together with the blower 320 is retracted in a direction of an arrow X1 so as to be apart from the developing electrode 316*a* of the developing device 316 against the biasing force of the compression spring 352 in cooperation with the rotational operation of the nozzle moving lever 353 in a retracted direction caused by the rotation of the nozzle moving cam 339.

Accordingly, even when the liquid developer is supplied from the developing electrode 316*a* which is subjected to the attitude control before developing of the photosensitive medium, the liquid developer does not flow into the nozzle 320*a* of the blower 320 because the nozzle 320*a* is retracted from the developing electrode 316*a*. This prevents the nozzle 320*a* from being choked at the distal end thereof with the liquid developer.

Next, referring to FIGS. 14(B) and 15, after the attitude control (shown as (e) in FIG. 15) of the developing electrode 316*a* has been completed and controlled at a predetermined angle with respect to the rotary drum 306, the development of the photosensitive medium 302 recorded with the electrostatic latent image is started by using the yellow liquid developer supplied from the developing electrode 316*a*.

Just before starting of the development of yellow (Y) as the first color, the nozzle 320*a* along with the blower 320 is displaced in the direction of the arrow X2 by the biasing force of the compression spring 352 in cooperation with a rotation of the nozzle moving lever 353 caused by a further rotation of the nozzle moving cam 339, thus, the distal end of the nozzle 320*a* is positioned in close proximity to the developing electrode 316*a* in the developing device 316.

On this occasion, the positioning pin 320*b* of the blower 320 abuts on the stopper surface 351*a* provided on the blower mounting base 351 by the biasing force of the compression spring 352, thus the distal end of the nozzle 320*a* is positioned at a narrow clearance from the developing electrode 316*a* in the developing device 316. As seen from the above description, the distal end of the nozzle 320*a* of the blower 320 maintains a close state to the developing electrode 316*a* in the developing device 316 only during the development of yellow (Y) color, and the excess liquid developer maintained on the surface of the photosensitive medium 302 is blown away therefrom by the air from the nozzle 320*a* of blower 320. Thus, this enables to prevent the adherence of the liquid developer on the photosensitive medium 302 of which the development has been completed.

As shown in the timing chart of FIG. 15, after the development (shown as (f) in FIG. 15) of yellow (Y) has been completed, the nozzle 320*a* together with the blower 320 is displaced against the biasing force of the compression spring 352 in a retracting direction from the developing electrode 316*a* of the developing device 316 in cooperation with a rotational operation of the nozzle moving lever 353 caused by the further rotation of the nozzle moving cam 339. After the development of yellow (Y) has been completed, the developments of the photosensitive medium 301 are successively performed in the same manner as mentioned above with respect to magenta (M), cyan (C) and black (B) developments every one revolution of the rotary drum 306.

As mentioned in the foregoing, in the excess liquid developer removing device 301 of the present invention, the nozzle 320*a* for blowing the air is positioned in close proximity to the developing electrode 316*a* (~319*a*) during the development of the photosensitive medium 302. On the other hand, the nozzle 320*a* is retracted from the developing electrode 316*a* (~319*a*) except for the period of the developing. Thus, the liquid developer supplied from the developing electrode 316*a* (~319*a*) does not flow into the nozzle 320*a* retracted. This contributes to the increase of reliability and performance of the excess liquid developer removing device 301.

[A sixth embodiment]

A description is now given of a sixth embodiment of the image recording apparatus, in particular, regarding a second embodiment of the excess liquid developer removing device of the present invention with reference to FIGS. 17 through 21.

Figure 17:
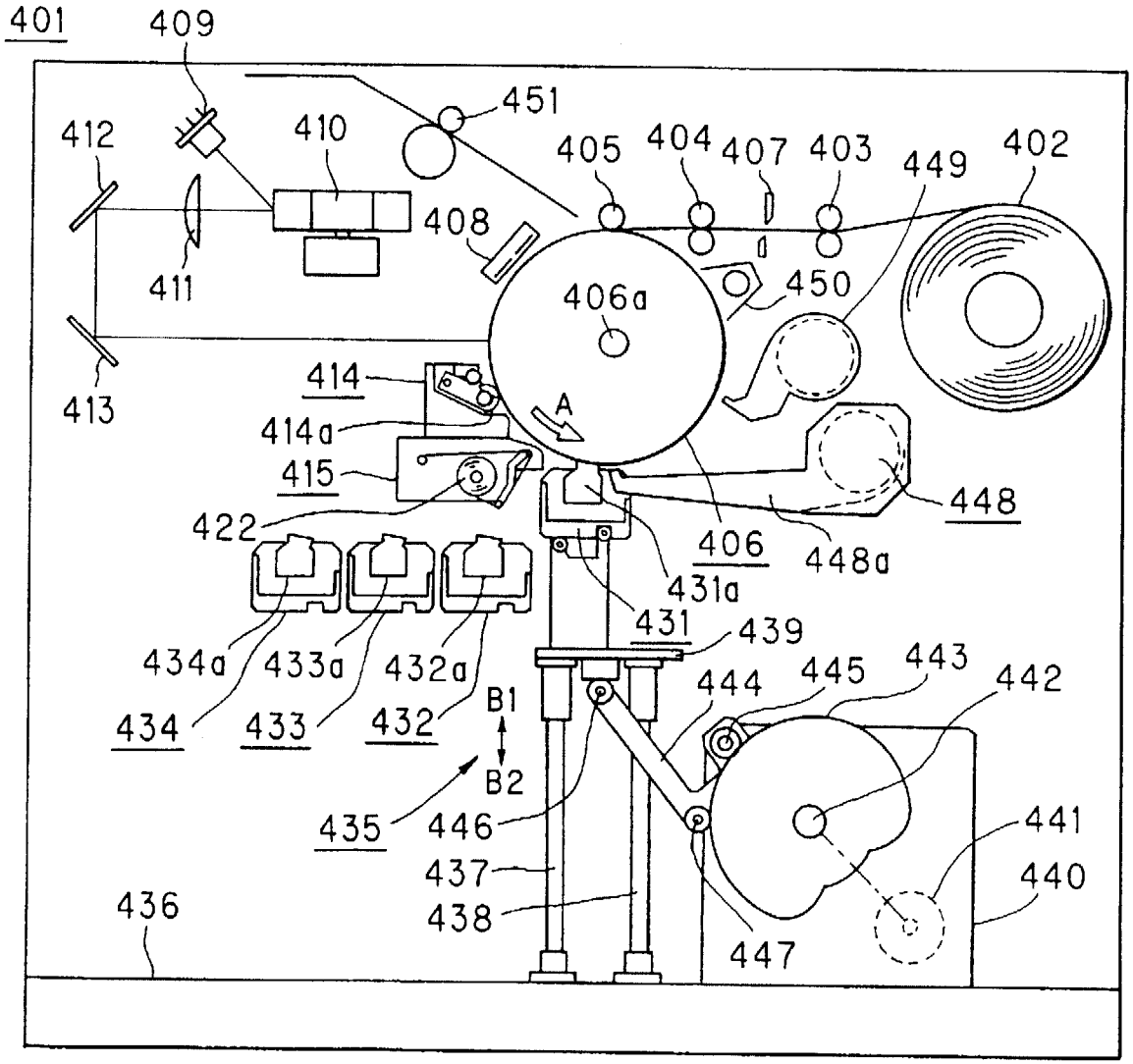
FIG. 17 is a side view schematically showing a sixth embodiment of the image recording apparatus, in particular, regarding another excess liquid developer removing device of the present invention.

FIG. 17 is a side view schematically showing a sixth embodiment of the image recording apparatus, in particular, regarding another excess liquid developer removing device of the present invention.

Figure 18:
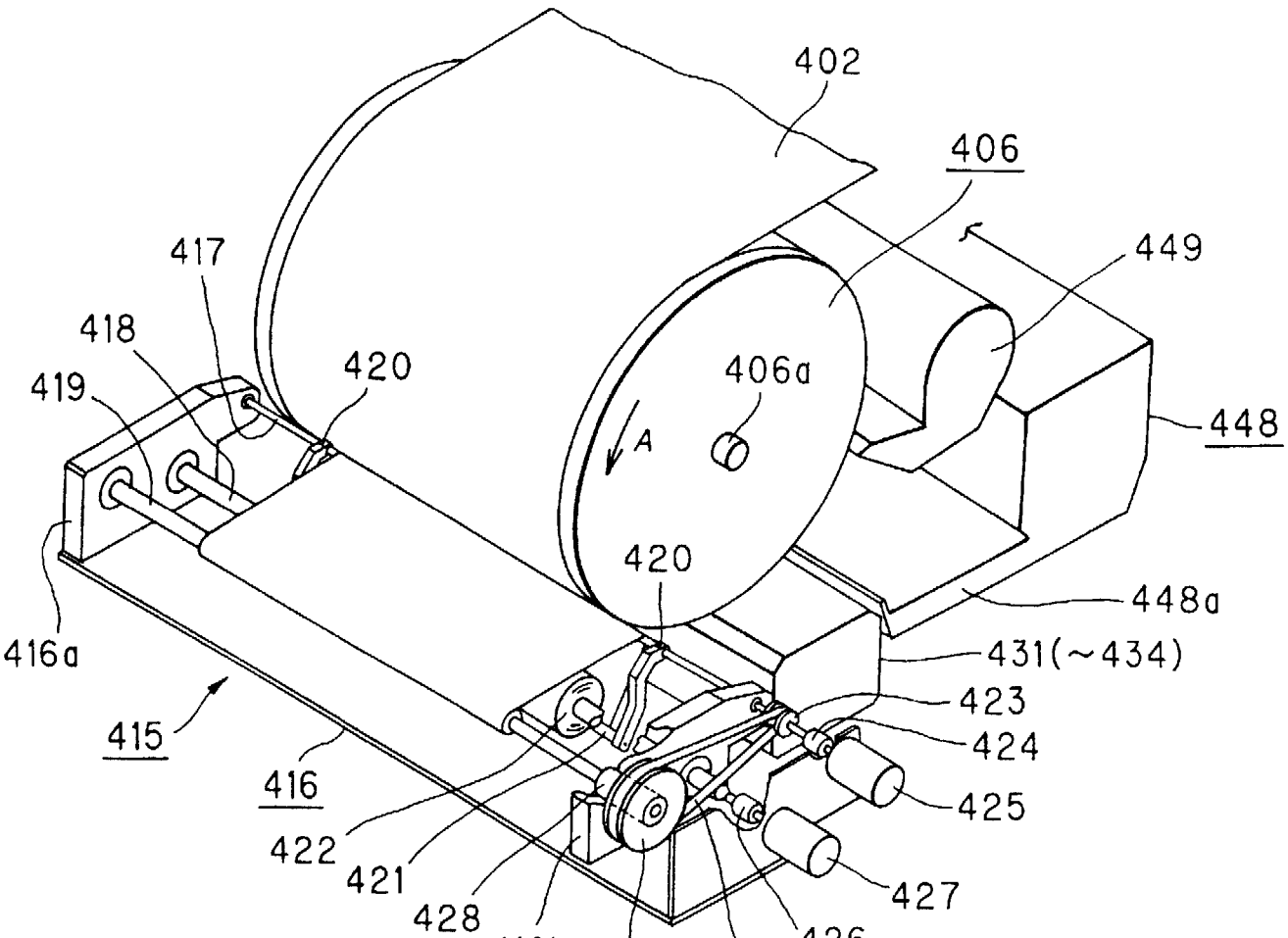
FIG. 18 is a perspective view showing another excess liquid developer removing device shown in FIG. 17.

FIG. 18 is a perspective view showing another excess liquid developer removing device shown in FIG. 17.

Figure 19A:
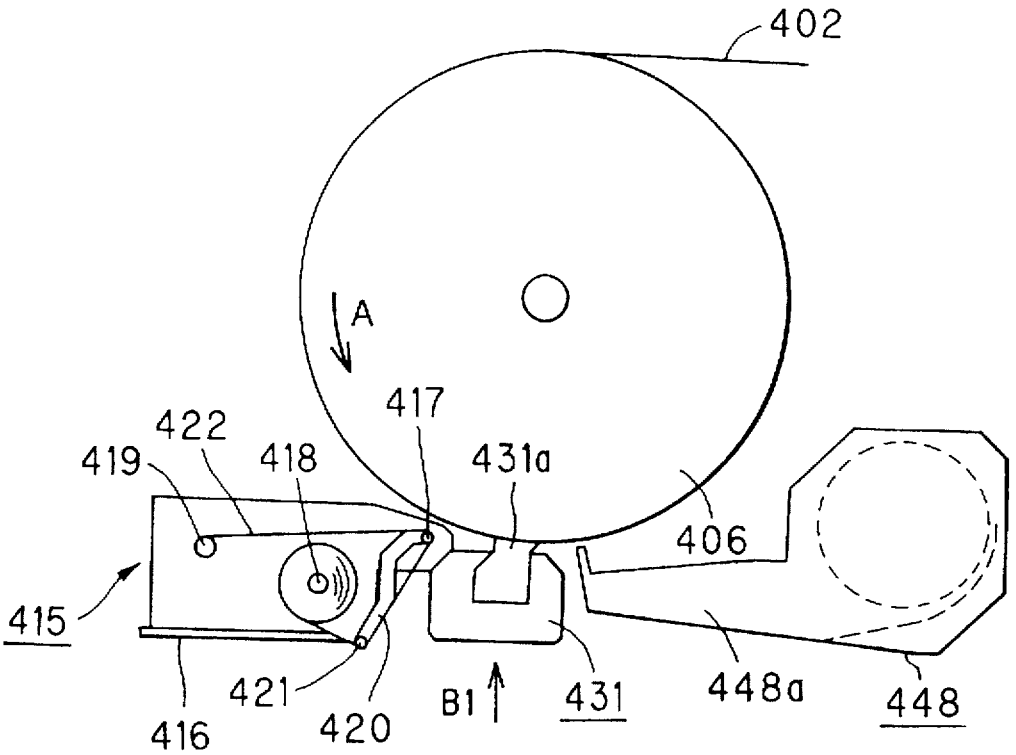
FIGS. 19(A) and 19 (B) are side views for explaining operation of another excess liquid developer removing device shown FIG. 17.

FIGS. 19(A) and 19 (B) are side views for explaining operations of another excess liquid developer removing device shown FIG. 17.

Figure 20:
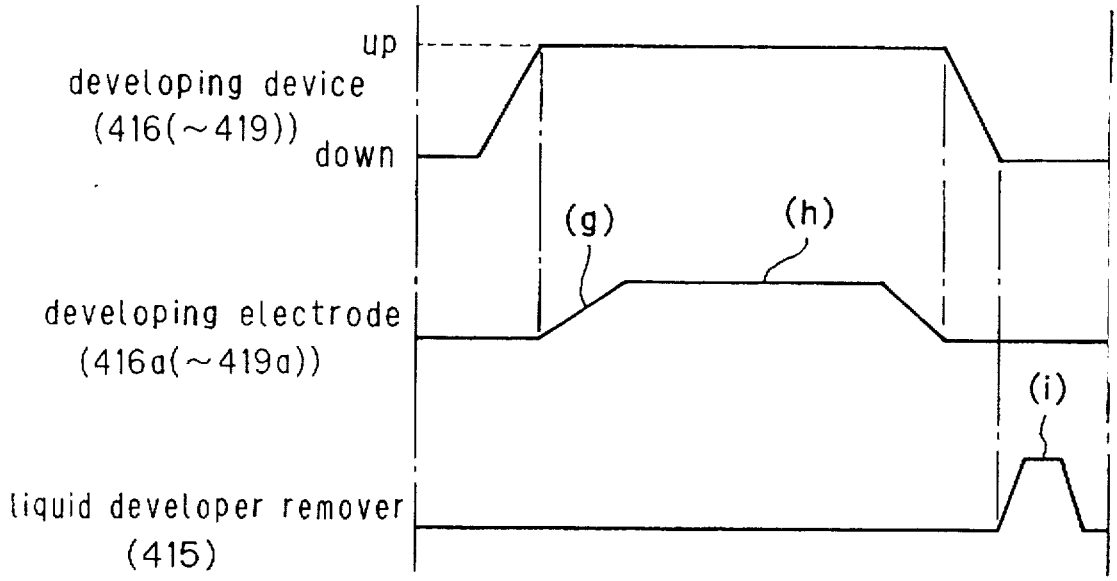
FIG. 20 is a timing chart showing operation of another embodiment of the excess liquid developing device.

FIG. 20 is a timing chart showing operations of another embodiment of the excess liquid developing device.

Figure 21:
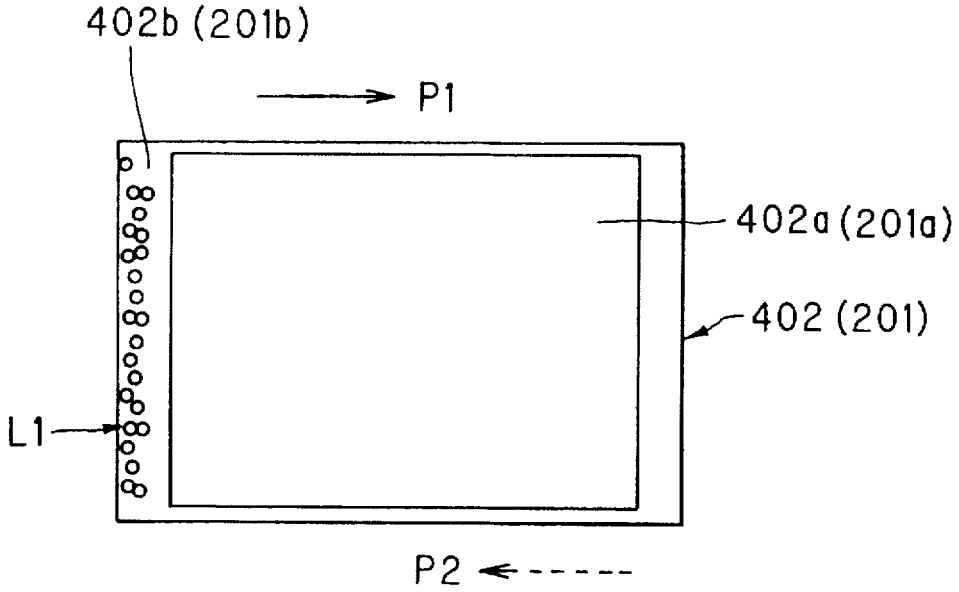
FIG. 21 is a plan view showing a state where the excess liquid developer is collected to an end of a mask area by air from a nozzle.

FIG. 21 is a plan view showing a state where the excess liquid developer is collected to an end of a mask area by air from a nozzle.

Referring to FIG. 17, an excess liquid developer removing device 401 of the second embodiment is constructed to be applied to a wet type photographic apparatus. In the excess liquid developer removing device 401, a photosensitive medium (recording medium) 402 is mounted in a rolled state. The photosensitive medium 402 is fed by two pairs of rollers 403, 404 in a direction toward a rotary drum 406 and is integrally transferred along with the rotary drum 406 in a counterclockwise direction as shown in an arrow A in such a manner that the photosensitive medium 402 is fixed on the surface of the rotary drum 406 by a sucking operation of a vacuum device (not shown) installed in the rotary drum 406 in cooperation with a pressing operation of a pinch roller 405. After that, the photosensitive medium 402 is cut by a predetermined length by a cutter 407 disposed between the rollers 403 and 404.

Further, the photosensitive medium 402 transferred integrally along with the rotary drum 406 is homogeneously electrified by an electrification device 408 disposed in the vicinity of an upstream position of the photosensitive medium 402 with respect to a rotation of the rotary drum 406.

The image signals are emitted from a semiconductor laser 409 as respective modulated laser beams for every color component of an original image, for instance, a yellow (Y), a magenta (M), a cyan color (C) and a black (B) component. The laser beam is scanned in a direction of the axis 406*a* of the rotary drum 406 for every line by a polygon mirror 410. Thus, electrostatic latent image is recorded on the photosensitive sensitive medium 402 corresponding to the color component of the original image by exposing the photosensitive medium 402 to the laser beam passing through a lens 411, reflectors 412, 413 disposed in this order.

A pre-bath device 414 for avoiding uneven color density upon developing is provided in the vicinity of an downstream position of the photosensitive medium 402 with respect to the electrification device 408. Pre-bath liquid supplied from a liquid supply means (not shown) is coated on the surface of the photosensitive medium 402 in which the electrostatic latent image is recorded, by being poured on the surface of a roller 414*a*.

A terminal section excess liquid developer remover (referred to as excess liquid developer remover) 415 which is a main part of this embodiment, is removably provided in the vicinity of a downstream position of the pre-bath device 414 with respect to the photosensitive medium 402.

The excess liquid developer remover 415 has a function for removing the excess liquid developer collected at a terminal of a mask area 402*b* (FIG. 21) by the air from a nozzle 448*a* of a blower 448, and is provided in the vicinity of an upstream position of the photosensitive medium 402 with respect to the nozzle 448*a* of the blower 448.

As shown in FIG. 18, the above excess liquid developer remover 415 is provided with a first elongated shaft (referred to as first shaft) 417, a second elongated shaft (referred to as second shaft) 418 and a third elongated shaft (referred to as third shaft) 419 parallel to the shaft 406*a* of the rotary drum 406 between a pair of side plates 416*a*, 416*b* erected from an elongated base 416 provided along the rotary drum 406, wherein the first shaft 417 is provided on the side of the rotary drum 406, the second shaft 418 is provided on the lower middle sides of the side plates 416*a*, 416*b*, and the second shaft 418 is provided away from the rotary drum 406.

A pair of arms 420, 420 are fixedly hung downward on the first shaft 417 at a predetermined distance, and a guiding member 421 is provided between the ends of the pair of arms 420, 420 so as to be parallel to the axis 406*a* of the rotary drum 406.

Further, a roll of an excess liquid developer absorbing member (referred to as absorbing member) 422 is integrally provided at one end of the second shaft 418 so as to be rotatable along with the second shaft 418. Incidentally, the second shaft 418 has a function of a supplying shaft of the absorbing member 422, and the absorbing member 422 is made of a cloth being not woven, for example, for effectively absorbing the excess liquid developer attached on the terminal of the mask area 402*b* (FIG. 21) in the vicinity of an upstream position of the photosensitive member.

After the absorbing member 422 is pulled out from the roll thereof fixed on the second shaft 418 and is threaded under the guiding member 421 provided between the pair of arms 420, 420 and around (semicircle) the first shaft 417, the end of the absorbing member 422 is fixed on the third shaft 419. Thus, the absorbing member 422 is threaded so as to envelop the guiding member 421 and the first shaft 417. The third shaft 419 has a function for taking up the absorbing member 422.

On the outside of the side plate 416*b*, at one end of the first shaft 417 there is provided a small pulley 423, a coupling 424 and a motor 425, and at one end of the second shaft 418 there is provided a coupling 426 and a motor 427, and at one end of the third shaft 419 there is provided a large pulley 429 having one way clutch. Further, between the small and large pulley 423, 429 an endless belt 430 is provided.

The motor 425 connected to the first shaft 417 has both a function for extending the pair of arms 420, 420 downward by rotating the first shaft 417 in a counterclockwise direction and a function of taking up the absorbing member 422 on the third shaft 419 by rotating the large pulley 429 of the third shaft 419 by means of the belt 430.

On the other hand, the motor 427 connected to the second shaft 418 has both a function for providing a back tension to the absorbing member 422 and a function for returning back the pair of arms 420, 420 to an initial position when the motor 425 connected to the first shaft 417 is turned off.

The operation of the above excess liquid developer remover 415 is described along with operation of the excess liquid developer removing device 401 hereinafter.

Referring to FIG. 17 again, a developing device 431 which is selected among a plurality of developing devices 431–434, is provided movably in a perpendicular direction (arrows B1 and B2) under the rotary drum 406. The developing device 431 is situated in the vicinity of a downstream position of the photosensitive member 402 with respect to the excess liquid developer remover 415.

These plural developing devices 431–434 are respectively provided with an elongated developing electrode (431*a*–434*a*) therein. The developing devices 431–434 are provided for color-developing latent images recorded on the recording medium 402 corresponding to respective color components, for instance, the developing device 431 including the liquid developer for yellow (Y), the developing device 432 for magenta (M), the developing device 433 for cyan (C) and the developing device 434 for black (B). Thus, one of them is selectively mounted on a developing device mounting base 439 as mentioned hereinafter.

Upon developing the latent images recorded on the photosensitive medium 402 regarding respective colors, at first, the developing device 431 for yellow color (Y) is raised in vicinity of the rotary drum 406 thereunder by a developing device up-down displacing device (referred to as up-down displacing device) 435 as mentioned hereinafter. Then, the latent image recorded on the photosensitive member 402 is developed in yellow by causing the photosensitive medium 402 to contact with the yellow liquid developer from the developing electrode 431*a* in the developing device 431. After that, the same performance is successively followed for respective colors every one revolution of the rotary drum 406 by using the developing devices 432–434 for magenta (M), cyan (C) and black (B).

The above up-down displacing device 435 comprises a base 436, plural shafts (only two shafts are shown) 437, 438 erected from the base 436, and a developing device mounting base 439 provided on the plural shafts 437, 438 for selectively mounting one of the developing devices 431–434. Further, a cam supporting plate 440 erects from the base 436, and on the cam supporting plate 440 a motor 441 as a driving source and a rotatable shaft 442 connected to the motor 441 through a speed reducer (not shown) are provided. At the end of the rotatable shaft 442, a cam 443 is fixedly provided for displacing one of the developing devices 431–434 in directions shown with arrows B1 and B2.

Further, an L-letter shape lever 444 for displacing the developing device mounting base 439 is rotatably supported at an one end thereof by a shaft 445 provided on the cam supporting plate 440. The L-letter shape lever 444 is provided with a roller 446 at an distal end thereof and with a cam follower 447 at a middle thereof to engage with the cam surface of the cam 443. Thus, the developing device mounting base 439 on which the developing device 431 (~31) is mounted, can be displaced upward and downward in accordance with motion of the roller 446 of the L-letter shape lever 444 which is rotated by the contact of the cam follower 447 with the cam surface of the cam 443 when the cam 443 is rotated by the motor 441.

Further, the blower 448 equipped with the nozzle 448*a* for blowing the air is provided in vicinity of the developing electrode 431*a* (~434*a*) provided in the developing device 431 (~434) which is displaced under the rotary drum 406. The blower 448 is situated in the vicinity of a downstream position of the photosensitive medium 402 with respect to the rotary drum 406 so as to blow away the excess liquid developer attached on the image area 402*a* (FIG. 21) of the photosensitive medium 402. At that time, the excess liquid developer blown away tends to be collected to the end portion of the mask area 402*b* of the photosensitive medium 402.

Further, in the vicinity of a downstream position of the photosensitive medium 402 with respect to the nozzle 448*a* of the blower 448, there is provided a dryer 449 for drying the photosensitive medium 402 after developed and a discharger 450 for discharging the electrostatic charges remained on the photosensitive medium 402. Furthermore, a pair of rollers 451 are provided on an upper left hand side of the rotary drum 406 so as to discharge the photosensitive medium 402 which has undergone the development process by the apparatus.

Next, a description is given of the operation of the excess liquid developer remover 415 of the excess liquid developer removing device 401 with reference to FIGS. 17 through 20.

As shown in FIG. 17, when the cam 443 of the up-down displacing device 435 is rotated, the developing device 431 for yellow color(Y) mounted on the developing device mounting base 439 is displaced to a position under the rotary drum 406 in a direction of an arrow B1 in accordance with the rising rotation of the L-letter arm 444 caused by the rotation of the cam 443. After the developing device 431 has been raised, the developing electrode 431*a* of the developing device 431 is slowly controlled to have a predetermined angle against the rotary drum 406 by an attitude control means (not shown). Incidentally, the cam 443 is being rotated during the attitude controlling.

After the developing electrode 431*a* has been controlled to have the predetermined angle, the development is started for the photosensitive medium 402 recorded with the latent image by using the liquid developer supplied from the developing device for yellow (Y). At the same time, the excess liquid developer attached on the image area 402*a* is blown away by the air from the nozzle 448*a* of the blower 448 approaching in the vicinity of the developing electrode 431*a*, and is recovered in the developing device 431.

On the other hand, when the photosensitive medium 402 is transferred in a direction of an arrow A along with the rotary drum 406, one part of the excess liquid developer blown away is collected to the terminal of the mask area 402*b* (FIG. 21) in the vicinity of an upstream position of the photosensitive medium 402, wherein an arrow P1 designates a transferring direction of the photosensitive medium 402.

When the development of the yellow color with respect to the image area 402*a* (FIG. 21) has been completed, the terminal of the mask area 402*b* comes to a position to face the developing electrode 431*a* by stopping the rotation of the rotary drum 406.

Incidentally, the excess liquid developer remover 415 which is a main part of the present invention is ready to start as shown in FIG. 19 (A) without any positive operation.

Figure 19B:
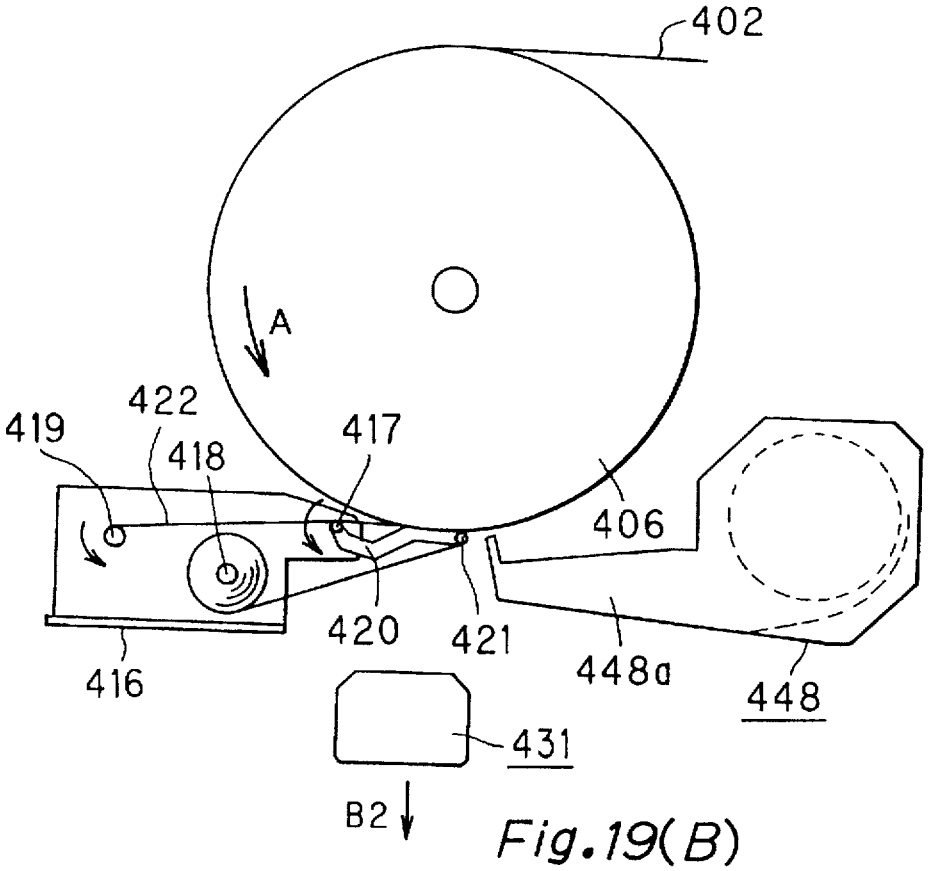

Next, as shown in FIG. 19(B), at a time when the first development of yellow color (Y) of the photosensitive medium 402 has been completed, the developing device 431 descends in a direction of an arrow B2 so as to retract from the rotary drum 406 by the up-down displacing device 435. Thereby, an open space is defined under the rotary drum 406. At that time, the terminal of the mask area 402*b* (FIG. 21) remains under the rotary drum 406.

On the other hand, at this stage where the first development (yellow color) has completed and the developing device 431 has descended, the excess liquid developer remover 415 which is a main part of the present invention operates as shown in FIG. 20, wherein a state (g) designates that the developing electrode 431*a* is undergoing an attitude modification, and a state (h) designates that the photosensitive medium 402 is in the midst of developing, and a state (i) designates that the excess liquid developer is being removed, and an arrow P1 (FIG. 21) shows a transferring direction of the photosensitive medium 402, and an arrow P2 shows an air blowing direction of the nozzle 448*a* and a character "L1" shows the excess liquid developer.

As shown in FIGS. 18, 19(A) and 19(B), at first, the first shaft 417 is rotated in the counterclockwise direction by causing the motor 425 to drive. Then, the guiding member 421 provided between the pair of arms 420, 420 which are fixed on the first shaft 417 is rotated in the counterclockwise direction (viewed from the right), and a part of the absorbing member 422 threaded on the guiding member 421 approaches to and abuts on the end portion of the mask area 402*b* (FIG. 21) of the photosensitive medium 402, being extended into the open space under the rotary drum 406. At this stage, the rotary drum 406 is rotated in the direction of the arrow A again. Thus, the excess liquid developer collected to the terminal of the mask area 402*b* by the blowing air is effectively absorbed or removed by the part of the absorbing member 422 abutting thereon.

On the other hand, when the first shaft 417 is rotated in the counterclockwise direction, the rotation of the small pulley 423 fixed on the first shaft 417 is transmitted to the large pulley 429 by means of the belt 430. The large pulley 429 has the one way clutch 428 which allows to transmit a rotation in the counterclockwise direction only, so that the absorbing member 422 is taken up by the third shaft 419. Thus, the part of the absorbing member 422 to be contacted with the terminal of the mask area 402*b* is always renewed by being taken up by the third shaft 419 corresponding to the rotation of the first shaft 417 in the counterclockwise direction.

Further, upon taking up the absorbing member 422, a back tension is given to the absorbing member 422 by rotating the second shaft 418 in the clockwise direction by the motor 427 connected to the second shaft 418.

When the removal of the excess liquid developer attached on the end of the mask area 402*b* has been completed, the rotation of the motor 425 is stopped (OFF). At the same time, the second shaft 418 is further rotated in the clockwise direction by successively driving the motor 427 connected to the second shaft 418. Thus the pair of arms 420, 420 returns to the initial position as shown in FIG. 19(A), being rotated by the first shaft 417 in the clockwise direction and being pulled by the absorbing member 422 threaded on the guiding member 421 because a part of the absorbing member 422 threaded on the guiding member 421 is taken up by the second shaft 418. At this stage, the motor 427 is stopped (OFF). Incidentally, when the rotation of the first shaft 417 is stopped (OFF), the absorbing member 422 wound around the third shaft 419 is not loosened because the one way clutch 428 engaging with the third shaft 419 is inhibited to transmit a rotation to the third shaft 419 in the clockwise direction or the loosening direction of the absorbing member 422.

After the pair of arms 420, 420 are returned in the initial position, in other words, after the operation of the excess liquid developer remover 415 has been completed, the same performance is successively followed for respective colors at every revolution of the rotary drum 406 by using the developing devices 432–434 for magenta (M), cyan (C) and black (B). Incidentally, every completion of the development of a color, the excess liquid developer remover 415 operates in the same manner as mentioned above.

As mentioned in detail, according to the excess liquid removing device 401 of the present invention, when the electric latent image recorded on the photosensitive medium 402 wound around the rotary drum 406 is developed by liquid developer supplied from the developing device 431 (~434) displaced in the vicinity of the photosensitive medium 402 wound around the rotary drum 406, the excess liquid developer attached to the photosensitive medium 402 is collected to an end of the photosensitive medium 402 by the air from the nozzle 448*a* provided in the vicinity of a downstream position of the photosensitive medium 402 with respect to the developing device 431. The excess liquid developer is removed by a part of the excess liquid developer absorbing member 422 caused by the contact therewith. Thus it is possible to remove the excess liquid developer completely on the surface of the photosensitive medium 402. This contributes not only producing the high quality of reproduced image but also the increase of reliability of the excess liquid removing device 401.

Further, in the excess liquid removing device 401 of the present invention, a roll of an excess liquid developer absorbing member 422 is provided so as to allow taking up one end thereof, thus upon operation, it is possible to efficiently absorb the excess liquid developer by renewing the part of the absorbing member 422 by taking up the one end thereof.

What is claimed is:

1. An image recording apparatus for recording an electriclatent image on a recording medium by electrifying a surface of the recording medium electrified thereon and for developing the electric latent image by using liquid developer, the image recording apparatus comprising:

a rotary drum provided on a rotatable shaft with the recording medium being wound around the rotary drum;

a developing dish movably provided upward and downward under the rotary drum, the developing dish having a confronting surface with a concave portion extending along a periphery of the rotary drum and a slit in the confronting surface in the vicinity of an upstream position of the recording medium with respect to the confronting surface for supplying a liquid developer to the confronting surface;

developing dish moving means for moving the developing dish in an upward or a downward direction during a developing operation with the developing dish being transferred close to the rotary drum from a lower position to form a predetermined space to allow the latent image formed on the recording medium to be developed by being contacted with the liquid developer supplied from the slit, and developing dish posture control means for controlling the posture of the developing dish in cooperation with the developing dish moving means so that when the developing dish is transferred close to the rotary drum, the developing dish is declined at a predetermined declined angle to allow a portion of the confronting surface located in a side of the slit thereof to approach the rotary drum and to modify the declined angle to form a uniform spacing between the confronting surface and the recording medium wound around the rotary drum.

2. An image recording apparatus as claimed in claim 1, wherein the predetermined declined angle of the concave surface is defined around an axis parallel to the rotatable shaft of the rotary drum.

3. An image recording apparatus as claimed in claim 1, the apparatus further comprising a container for storing the liquid developer, an accommodating section for accommodating the developing dish as well as recovering the liquid developer supplied from the slit of the developing dish and a channel provided between the container and the developing dish for feeding back the liquid developer to the slit of the developing dish.

4. An image recording apparatus as claimed in claim 3 wherein the development dish moving means includes a first cam for moving the accommodating section accommodating the developing dish upward and downward, and wherein the development dish posture control means includes a second cam for declining the declined angle of the confronting surface of the developing dish, with the first and second cams integrally provided to allow the posture of the developing dish to be controlled in cooperation with the operation of the developing dish moving means.

5. An image recording apparatus as claimed in claim 1, further comprising flow rate control means for variably controlling a flow rate of the liquid developer flowing in the channel.

6. An image recording apparatus as claimed in claim 5, wherein the flow rate controls means control an amount of flowing liquid developer from the slit in the channel so that the amount of flowing liquid developer is larger before beginning the development of the latent image than that in developing the latent image during the developing process.

7. An image recording apparatus as claimed in claim 1, wherein the liquid developer is contacted with the recording medium in a process where the declined angle is modified so as to form the uniform spacing between the recording medium wound around the rotary drum and the concave surface.

8. An image recording apparatus as claimed in claim 7, wherein the declined angle is modified after a predetermined time interval.

9. An image recording apparatus as claimed in claim 8, wherein the declined angle is modified at a larger speed after the predetermined time interval than at an initial speed before the predetermined time interval.

10. An image recording apparatus for recording an image on a recording medium by electrifying a surface of the recording medium electrified thereon and for developing the electric latent image by using liquid developer, the image recording apparatus comprising:

a rotary drum provided at a rotatable shaft with the recording medium being wound around the rotary drum;

a developing dish movably provided upward and downward under the rotary drum, the developing dish having a confronting surface with a concave portion extending along a periphery of the rotary drum and a slit in the confronting surface in the vicinity of an upstream position of the recording medium with respect to the confronting surface for supplying a liquid developer to the confronting surface; and developing dish moving means for moving the developing dish in an upward or a downward direction, during developing operation with the developing dish being transferred close to the rotary drum from a lower position to form a predetermined space to allow the latent image formed on the recording medium to be developed by being contacted with the liquid developer supplied from the slit, wherein a length between the slit and an end portion of the confronting surface located in an opposite side of the slit along the periphery of the rotary drum is determined so that the liquid developer flowing over the developing dish has at least a convex surface including a flat surface in section before the recording medium is contacted with the liquid developer.

11. An image recording apparatus as claimed in claim 10, wherein the length between the slit and the end portion of the confronting surface is determined to be 5 mm to 15 mm.

12. An excess liquid developer removing device used in an image recording apparatus to record an image on a photosensitive medium by forming an electric latent image on a photosensitive medium and developing the electric latent image by using liquid developer, the excess liquid developer removing device comprising:

a rotary drum rotatable about a shaft in common with the photosensitive medium so as to be integrally rotated with the photosensitive medium;

a developing device movably provided under the rotary drum for supplying the liquid developer to the photosensitive medium so as to develop the electric latent image recorded on the photosensitive medium;

developing device displacing means for displacing the developing device to a developing position located in the vicinity of the photosensitive medium with the developing device displacing means wound around the rotary drum to allow the development of the photosensitive medium in a developing process;

a blower having a nozzle from which a air is applied to blow away excess liquid developer attached on the photosensitive medium in the developing process, the nozzle being provided in the vicinity of a downstream position of the photosensitive medium with respect to the developing device; and nozzle displacing means for displacing the nozzle in the vicinity of the developing device in the midst of the developing process.

13. An excess liquid developer removing device as claimed in claim 12, wherein the nozzle displacing means comprising a driving source which is used in common for the developing device displacing means, first cam means connected to the driving source for displacing the developing device to the developing position and second cam means connected to the driving source in accordance with a phase of the first cam means for displacing the nozzle of the blower in the vicinity of the electrode of the developing device.

14. An excess liquid developer removing device used in an image recording apparatus to record an image on a photosensitive recording medium by forming an electric latent image on a photosensitive medium and developing the electric latent image by using liquid developer, the excess liquid developer removing device comprising:

a rotary drum provided on a rotatable shaft with the photosensitive recording medium being wound around the rotary drum and being rotated a plurality of times in a developing process; plural developing devices filled with liquid developers corresponding to plural colors, each of the plural developing devices being movably provided under the rotary drum for supplying each of the liquid developers to the photosensitive recording medium, each of the plural developing devices being successively approached to the rotary drum so as to develop the electric latent image recorded on the photosensitive recoroding medium by each of the liquid developers supplied from each of the plural developing devices at every color, a blower having a nozzle from which a air is applied to the excess liquid developer attached on the photosensitive recording medium so as to be blown away to one end of the photosensitive recording medium in the developing process, the nozzle being provided in the vicinity of a downstream position of the photosensitive recording medium with respect to the developing device; and an excess liquid developer remover comprising an excess liquid developer absorbing member being wound in a rolled state with one end of a roll of the excess liquid developer absorbing member allowed to be taken up, wherein the excess liquid developer collected to the end of the photosensitive recording medium by the air from the nozzle of the blower is removed by a part of the excess liquid developer absorbing member caused by contact with the excess liquid developer collected during a rotation of the rotary drum after one revolution of the rotary drum is completed.

* * * * *